US007563207B1

(12) United States Patent
Burek

(10) Patent No.: US 7,563,207 B1
(45) Date of Patent: Jul. 21, 2009

(54) STRETCHING MACHINE WITH REAL TIME FLEXIBILITY FEEDBACK

(76) Inventor: Denis E. Burek, 4590 Hyde Rd., Cumming, GA (US) 30040

( * ) Notice: Subject to any disclaimer, the term of this patent is extended or adjusted under 35 U.S.C. 154(b) by 738 days.

(21) Appl. No.: 11/178,023

(22) Filed: Jul. 11, 2005

Related U.S. Application Data

(60) Provisional application No. 60/589,161, filed on Jul. 19, 2004.

(51) Int. Cl.
*A61H 1/02* (2006.01)

(52) U.S. Cl. ..... 482/91; 482/8; 482/131; 482/138; 482/147; 482/907

(58) Field of Classification Search ..... 482/79, 482/80, 91, 95, 131, 137, 138, 146, 147, 482/907, 8, 9; 601/23, 34, 35; 602/23, 32; 128/845
See application file for complete search history.

(56) References Cited

U.S. PATENT DOCUMENTS

| | | | | |
|---|---|---|---|---|
| 4,089,330 | A * | 5/1978 | Nicolosi et al. | 601/33 |
| 4,807,601 | A * | 2/1989 | Wright | 601/34 |
| 4,892,304 | A | 1/1990 | DeNiro | |
| 4,915,378 | A * | 4/1990 | Abrahamian et al. | 482/137 |
| 4,934,694 | A * | 6/1990 | McIntosh | 482/9 |
| 4,964,629 | A * | 10/1990 | Wright | 482/83 |
| 5,147,266 | A * | 9/1992 | Ricard | 482/131 |
| 5,232,427 | A | 8/1993 | Paro | |
| 5,277,681 | A * | 1/1994 | Holt | 482/112 |
| 5,328,426 | A * | 7/1994 | Vendette | 482/91 |
| 5,558,607 | A | 9/1996 | Darling | |
| 5,662,592 | A | 9/1997 | Brady | |
| 5,679,104 | A * | 10/1997 | Driscoll | 482/91 |
| 5,938,573 | A * | 8/1999 | Davies et al. | 482/131 |
| 6,338,700 | B1 | 1/2002 | Pollock | |
| 7,160,234 | B2 * | 1/2007 | Dise | 482/142 |
| 2002/0193710 | A1 * | 12/2002 | Main et al. | 601/5 |
| 2005/0209055 | A1 * | 9/2005 | Anders | 482/51 |

FOREIGN PATENT DOCUMENTS

DE 3718643 A1 * 12/1988

* cited by examiner

*Primary Examiner*—Victor K. Hwang
(74) *Attorney, Agent, or Firm*—William B. Noll

(57) ABSTRACT

A muscle stretching machine designed to provide the user with easy system of functional stretching and also provide the user with flexibility feedback information as to the performance of the stretch, such as but not limited to the angles of the stretch, the force of the stretch, the position of the stretch, and the duration of the stretch. A user of the muscle stretching machine can turn on the central processor, adjust the height of the machine to suit their height or to suit the type of stretch to be performed, step onto a round turntable subassembly, place the leg to be stretched on a foam pad designed to raise and lower the leg, pull down on a handle to raise the leg being stretched and read the information displayed on the central processor. When the handles are pulled down the leg is raised. When the handles are allowed to go up the leg is lowered. When the leg is raised and lowered the displays on the control panel change in real time showing the raised or lowered angle of the leg, the, force required to raise or lower the leg, the amount of twist angle on the leg not being stretched, and the height of the pivot point of the stretch.

9 Claims, 24 Drawing Sheets

FEG. 12

STRETCHING MACHINE WITH REAL TIME FLEXIBILITY FEEDBACK

RELATED APPLICATION

This application relates to and claims priority of Provisional Patent Application Ser. No. 60/589,161, filed Jul. 19, 2004, by the inventor hereof and under the same title, where the contents thereof are incorporated herein by reference in their entirety.

FIELD OF THE INVENTION

This invention relates to the field of apparatus for stretching and exercising muscles of the body, more particularly to apparatus for [and] providing the user with real time flexibility feedback as to the performance of the stretch through the use of mechanical mechanisms, electronics, and software.

BACKGROUND OF THE INVENTION

This invention relates to a stretching machine for stretching the muscles of the body, while providing the user with real time flexibility feedback on the performance of the stretch. Many stretching machines have been invented but none have provided the user with electronic flexibility feedback information, which is a quantitative measure on the performance of the stretch, along with a dynamic muscle stretching platform. This machine allows the user to determine the work done by their muscles by providing both the force and displacement of the muscles being stretched. The invention described herein may be classified as an ergometer, an apparatus for measuring the amount of work done by a group of muscles under controlled conditions.

Stretching as part of an exercise program, or in preparation for an athletic event such as tennis, basketball, or ice hockey etc., is widely accepted by those skilled in the art as an important second step. The first step prior to performing an exercise program or an athletic event is to adequately warm up. After the body is warmed up, it is prepared to stretch the muscles, which if performed correctly on a regular basis will allow the muscles to improve their range of motion and become more flexible. Proper stretching will also prevent injury as a result of sudden or awkward movement.

Limitations on the amount a muscle is stretched occur as a result of the pain threshold of the person doing the stretching and the use of proper technique while stretching the muscle. If proper technique is not used or too much force is applied, then an injury could result. The ideal situation while stretching is to have the muscles properly warmed up, have the muscles in a relaxed state as they are stretched using proper technique, gradually apply force to the muscle, and then hold the stretch. However, the muscle to be stretched is usually never in a completely relaxed state as a result of the work required by the muscle to set up and then accomplish the stretch.

Exercise enthusiasts and athletes monitor their amount of muscle flexibility on a qualitative rather than a quantitative basis while stretching. One particular stretch routine is called the hurdler. The hurdler is where the person stretching sits on the floor with one leg straight out and the other leg bent back to their side. The person stretching then leans forward to stretch the leg placed straight out or lays back to stretch the leg bent back. When doing this stretch it is obvious that regardless of which leg is stretched only a certain amount of range of motion is allowed until the muscle cannot be stretched further. Exercise enthusiasts and athletes will determine their own flexibility by remembering how flexible they were during their previous stretching session and compare it to how flexible they are during their present stretching session. What may not be remembered is the amount of force required accomplishing the stretch, how long the stretch was held, and the exact amount of rotation measured in degrees, which was required to complete the stretch. A muscle stretching machine, which provides real time flexibility feedback information on the performance of a stretch, and allow the user to perform the stretches in a functional manner by standing instead of sitting or laying down would be of tremendous benefit to exercise enthusiasts and athletes.

On the other end of the physical performance spectrum are those individuals who must rehabilitate injured or diseased muscles. The muscle stretching machine described herein is also designed to be a very beneficial piece of rehabilitation equipment. Those skilled in the art of physical therapy will readily see the advantages of their patients using a muscle stretching machine, which provides the patient with instant and recorded flexibility feedback information. For example, if a patient was attempting to regain the use of the muscles in an injured leg, and part of the physical therapy called for the stretching of the injured muscle, then the patient would be able to obtain important information as the muscle was stretched. The muscle stretching machine would provide the patient with instant flexibility feedback information as to the force, angle, height, and duration of a stretch. It would allow the patient to compare their present results to the results recorded during previous stretching sessions. In this way the patient can easily see if they are improving, staying the same, or declining with regards to the flexibility portion of their rehabilitation. Furthermore, a physical therapist would be able to review the patient's information to improve the rehabilitation and monitor the progress of a number of patients.

Unlike the many inventions for stretching the muscles there are many inventions for cardiovascular and strength training which provide quantitative performance feedback to the user. The user of these pieces of cardiovascular and strength training equipment can use this feedback information to adjust their exercises and monitor their improvement. One example for cardiovascular fitness is the exercise bicycle with a programmable control panel. The rider of such a bicycle can select a program, a time, and a level of difficulty for each ride. If the rider successfully completes the ride with out being too exhausted, he or she will remember this. The next time they ride this bicycle they could increase the time or raise the level of difficulty in order to improve their cardiovascular fitness. Similarly with strength training, weights are used to improve the strength of the muscles. The weight lifter knows exactly how much weight is being lifted, the number of times lifted, and with an approximate time between lifts. The performance during the lift is used to adjust the amount of weight and the number of times the weight is lifted during the next exercise session.

Accordingly, there is a need in the art for a stretching device which provides the user with quantitative flexibility feedback while stretching their muscles. One embodiment of the present invention is to provide a stretching device, which may be used to stretch the major leg, abdominal, groin, and lower back muscles in an efficient, easy, and comfortable manner, while at the same time providing the user with immediate flexibility feedback on the performance of the stretch;

allow the user to adjust the force, duration, and range of the stretch, and perform the stretch in a functional manner.

SUMMARY OF THE INVENTION

The present embodiment of the invention is an improved system for stretching the leg, abdominal, groin, and lower back muscles and provides the user with flexibility feedback information as to the performance of the stretch. It consists of eight major subassemblies: Frame 100, Hand Crank 200, Leg Lift 300, Leg Lift Pad 400, Slack Cable 500, Turntable 600, Central Processor 700, and Cable Pull Down 800.

FRAME SUBASSEMBLY—A rectangular frame with vertical and horizontal structural members is the first subassembly and is used to support and attach the remaining seven subassemblies. The vertical structural members and the horizontal structural members of the frame are fabricated out of rigid, square, tubular cross section and rigid "U" shaped cross section, structural members. The openings of the two left "U" shaped cross section vertical structural members face each other, and are the two open channels which accept a leg lift subassembly and allow the leg lift to slide up or down in the vertical position. The openings of the two right "U" shaped cross section vertical structural members face each other, and are the two channels which accept a slack cable pulley subassembly and allow the slack cable pulley subassembly to slide up or down in the vertical position. The six lower structural members form the shape required to support and locate the six vertical structural members and properly locate the other seven subassemblies. On the top surfaces of two of the lower horizontal structural member are attached a chain sprocket. At the top of the six vertical structural members are five upper structural members form the shape required to support and locate the six vertical structural members and properly locate the other seven subassemblies. On the underside of two of the upper structural member are attached an encoder/sprocket sub subassembly and a double sprocket sub subassembly. The encoder in the encoder/sprocket sub subassembly is attached to the end of the sprocket shaft and it senses the rotation of the shaft and sends a signal to the central processor, which processes the signal and displays it as the height in inches from the turntable to the pivot point of leg rotation. The four sprockets located on the lower and upper horizontal structural members accept a robust, industrial quality type chain. The chain is used to raise the leg lift mechanism subassembly while lowering and the slack cable subassembly and vice versa. Eleven cable pulleys are located at the top of the frame subassembly. The first five pulleys accept a cable for counterbalancing the leg lift mechanism. These five counter balance pulleys route a first cable with one end beginning on the leg lift pad subassembly and the other end terminated to the top of the weight stack. This cable is used to provide a counter balance to lifting the leg lift pad subassembly, so that the force required lifting the leg is minimized. The remaining six pulleys route a second cable with one end beginning at the cable pull down subassembly and the other end terminated to the load cell. The second cable is used to raise and lower the leg lift pad subassembly as well as sense the force required to perform this lift.

The counter balance weight stack is fabricated from rigid square in cross section tubes. The weight stack guide is fabricated from rigid circular in cross section tubes. The counter balance weight stack is made in the shape of a rectangle, which allows its short sides to travels up and down along the vertical circular tubes, and allows its lower longer side to accept weights onto its weight pin. Weights are added to the weight stack and this weight provides the counter balance force, which assists the user to lift the leg lift pad subassembly.

The central processor is attached to the frame subassembly through the use of the horizontal central processor structural member. The horizontal central processor structural member is made from a rigid, square in cross section tube and spans between the second and third "U" shaped cross section vertical structural members and is located just above the hand crank subassembly.

The backrest sub subassembly is slidably attached to the front right square tubular cross section structural members so that when the user has their leg raised by the leg lift pad subassembly, their back rests against the backrest subassembly. The backrest sub subassembly consists of a rectangular shaped foam pad, brackets, and adjustment knobs. The user of this muscle stretching machine may adjust the backrest up or down, in or out depending upon their preference.

HAND CRANK SUBASSEMBLY—The hand crank subassembly is used to change the height of the leg lift subassembly. The hand crank subassembly is attached to the back right vertical structural member of the frame subassembly through the use of four crank beams. The hand crank subassembly consists of a hand crank, a worm gear, a worm a metal housing, a large sprocket and fastening hardware. The large sprocket is connected to a much smaller sprocket on the double sprocket sub subassembly by the use of a third robust, industrial quality chain. This chain forms a closed loop between these two sprockets. When the hand crank is rotated it subsequently rotates the large sprocket, which in turn rotates the smaller sprocket on the double sprocket sub subassembly. The user of this muscle stretching invention turns the crank on the hand crank subassembly to accurately position the pivot point of the leg lift subassembly to their desired height for stretching. When the user stops turning the crank the hand crank subassembly automatically locks the position of the leg lift subassembly.

LEG LIFT SUBASSEMBLY—The leg lift subassembly is used to sense the rotation of the leg lift pad subassembly, brake the rotation of the leg lift pad subassembly and provide hard stops for minimum and maximum rotation of the leg lift pad subassembly. As described previously, the leg lift subassembly is attached to the first and second "U" shaped cross section vertical structural members of the frame subassembly so that it may slide up or down in the channels of these vertical structural members. The leg lift subassembly consists of five sub subassemblies: a plate sub subassembly, a shaft sub subassembly, a brake sub subassembly, an upward stop sub subassembly and an encoder sub subassembly. When the user pulls down on the handles of the cable pull down subassembly it pulls up the twelfth pulley attached to side of the leg lift pad subassembly, and the pulley raises the leg lift pad subassembly (described below), which is attached to the end of the shaft on the leg lift subassembly. The shaft on the shaft sub subassembly is capable of rotating 180°, thereby allowing the leg lift pad subassembly to rotate 180°. The axis of the shaft is the pivot point of leg lift rotation and the height of this pivot point is adjusted by the hand crank subassembly (described above). The plate sub subassembly accepts the robust, industrial quality, type chains. The plate subassembly fits into the open channels of the first and second "U" shaped cross section vertical structural members, and allow the leg lift subassembly and the attached leg lift pad subassembly to travel up or down. The upward stop sub subassembly provides the user, especially a new user, with an upward stop to the amount of stretch that the stretched leg may see. The user may set the angle on the upward stop sub subassembly anywhere between 30 degrees and 150 degrees in increments of 10 degrees. Therefore, the user may select one of thirteen upward stop positions prior to using the machine, which will prevent over stretching the leg. The brake sub subassembly is use to stop the rotation of the leg lift pad subassembly and hold it in place until the user releases the brake. The encoder sub subassembly is attached to one end of the shaft sub subassembly and it senses the rotation of the shaft and sends a signal to the central processor, which processes the signal and displays it as the upward lift angle of the leg.

LEG LIFT PAD SUBASSEMBLY—The leg lift pad subassembly is used to raise and lower the leg being stretched. The leg lift pad subassembly consists of a leg pad, a twelfth pulley, a thirteenth pulley, framing material and fastening hardware. The user of this invention adjusts the position of the foam pad to the desired position for cradling the leg by unscrewing a knob on the catch mechanism and allowing the foam pad slide up or down the square tube. The user then places one leg on the foam pad. When the handles of the cable pull down subassembly are pulled down, the cable looped around the twelfth pulley raises this pulley, which in turn rotates the leg lift pad subassembly upward raising the user's leg. The leg lift pad subassembly allows the user to stretch their leg in a front or side leg lifts. It also allows the user to press the front of the thigh of their leg being stretched against their chest by raising the pivot point of the leg lift mechanism subassembly so that it is at chest height. The leg is then pressed against the users chest in the shape of an inverted "V" with only the lower portion of their leg from their knee to their heel on the foam pad. Then the user is allowed to concentrate the force of the stretch directly onto the hamstring muscles. The long sides of the foam pad are raised upward as an aid for keeping the leg on the foam pad. The thirteenth pulley accepts one end of the counter balance cable.

SLACK CABLE SUBASSEMBLY—The slack cable subassembly is used to take-in or payout cable slack when the leg lift subassembly is raised or lowered. The slack cable subassembly consists of a fourteenth pulley, chain bars, guide rods, weights, and fastening hardware. When the leg lift subassembly is raised or lowered, cable slack between the handle and the leg lift subassembly must be taken in or let out. The cable routed around the twelfth pulley on the leg lift pad subassembly and used to raise the leg lift pad subassembly is routed to the pulleys on the top of the frame, down to the fourteenth pulley located on the slack cable pulley subassembly, and then terminated to the load cell, which is mounted to the top frame of the machine. The other end of the cable is terminated into the cable pull down subassembly. As described previously the leg lift subassembly and the slack cable pulley subassembly are connected with a chain, each located on opposite sides of the machine. As a result of this chain connection, when the leg lift subassembly is raised the slack cable pulley subassembly is lowered. As a result the excess cable from the leg lift subassembly is transferred to the slack cable pulley subassembly. When the leg lift subassembly is lowered the required additional cable is paid out by the slack cable pulley subassembly. In each case the cable pull down subassembly remains in place and does not raise or lower when the leg lift subassembly is raised or lowered.

TURNTABLE SUBASSEMBLY—A turntable subassembly is used to allow the leg not being stretched to rotate either clockwise or counterclockwise. The turntable assembly consists of three sub subassemblies: a foot plate sub subassembly, a spring sub subassembly, and a brake sub subassembly. The spring sub subassembly is attached to the underside of the footplate sub subassembly. The encoder used to sense footplate rotation is an integral part of the spring sub subassembly. The encoder senses the rotation of the footplate sub subassembly and sends an electrical signal back to the central processor, which processes the signal and displays it as the twist angle of the leg. The brake sub subassembly keeps the footplate sub subassembly stationary until the user releases the brake lever. The purpose of the spring sub subassembly is to return the turntable to its start position when the user either steps off the turntable or releases the twist applied to the leg not being stretched. The spring sub subassembly also limits the turntable rotation to 180 degrees clockwise or 180 degrees counterclockwise. The turntable is returned to the start position regardless if the turntable is rotated in the clockwise or counterclockwise direction. The turntable subassembly is conveniently positioned below and just behind the leg lift pad subassembly and attached adjacent to the bottom of the frame subassembly. This positioning of the turntable subassembly allows the user to place the leg being stretched on the foam pad of the leg lift pad subassembly and place the foot of the leg not being stretched in the center of the round turntable.

CENTRAL PROCESSOR—A central processor is used to receive and process information from the leg lift subassembly, the frame subassembly, and the turntable subassembly. The information received from each subassembly is processed inside the control box and then digitally displayed on the front face of the central processor. The central processor consists of a control box, three digital encoders, a load cell, control cable, four digital displays, on/off switch, a quantity of switches, a circuit board, four AA batteries, a gear train, a battery cover plate and fastening hardware. The first digital encoder is attached to the leg lift subassembly. It senses the rotation of the leg lift mechanism subassembly and transmits this information to the central processor. The information is processed and displayed in degrees and it is the upward angle of the leg being stretched. The second digital encoder is attached to the frame subassembly. It senses the rotation of the fourth sprocket and transmits this information to the central processor. The information is processed and displayed in inches and it is the height measured from the top surface of the turntable subassembly to the pivot point of the leg lift subassembly. The third digital encoder is attached to the turntable subassembly. It senses the rotation of the round plate and transmits this information to the central processor. The information is processed and displayed in degrees and it is the amount of rotation or twist of the leg not being stretched. The load cell is attached to the frame subassembly. It senses the amount of force on the cable required to lift the leg lift pad subassembly and transmits this information to the central processor. This information is processed and is displayed in pounds and it is the amount of force the user exerts pulling down on the cable pull down subassembly.

CABLE PULL DOWN SUBASSEMBLY—The user grips the handles on the cable pull down subassembly, and pulls down on the handles to raise the leg lift pad subassembly. The cable pull down subassembly consists of three sub subassemblies: a spring sub subassembly, a brake sub subassembly, and a handle sub subassembly. If the user cannot reach the handles on the cable pull down subassembly, then the cable stored inside the cable pull down subassembly may be paid out until the user is able to reach the handles on the cable pull down subassembly. The brake sub subassembly locks the cable spool in place when the cable pull down subassembly is being pulled down by the user. The spring sub subassembly allows the cable to retract into the cable pull down subassembly when the brake sub subassembly is released.

ADVANTAGES—Accordingly several features of the invention are to provide immediate real time flexibility feedback as to the performance of the stretch, to provide the user with instant feedback as to the upward angle of the leg being stretched, to provide the user with instant feedback as to the force required to hold the stretch, to provide the user with instant feedback as to the amount of twist applied to the leg not being stretched, to provide the user with instant feedback as to the height of the pivot point for upward leg rotation of the leg being stretched, to provide the user with a method of adjusting the height of the pivot point of rotation of the leg lift pad, to provide the user with the ability to stretch their leg with the pivot point of leg lift pad subassembly rotation located above the pivot point of the user's leg joint thereby allowing the stretch to include more of the user's abdominal, groin muscles and other leg muscles, to allow the user to easily switch between front and side leg raises, to allow the user to be held upright through the use of the back rest subassembly, and most importantly to allow the user to stretch their leg in an active weight bearing position known as functional stretching. Still further objects and advantages will become apparent from a study of the following detailed description and the accompanying drawings.

DETAILED DESCRIPTION OF THE INVENTION

The following detailed description and the accompanying drawings are provided for the purpose of describing certain presently preferred embodiments of the invention only, and are not intended to limit the scope of the claimed invention in any way.

As will be apparent from the following description of the operation of the stretching apparatus of this invention, a unique feature thereof is the triangulation of the stretching process for the user. The vertices of the triangle are located at (a) the pivot point of the user's joint, i.e. the hip pivot point, (b) the pivot point of the leg lift pad, and (c) the point where the leg lift force is applied. These three vertices form a triangle. The vertices located at the user's pivot point and the point where the leg lift force is applied remain constant, their locations never change for the particular user. The vertex located at the pivot point of the leg lift pad may be moved up or down. This is only limited by the height of the apparatus and the ability of the user to place their leg on the leg lift pad.

Figure 1:
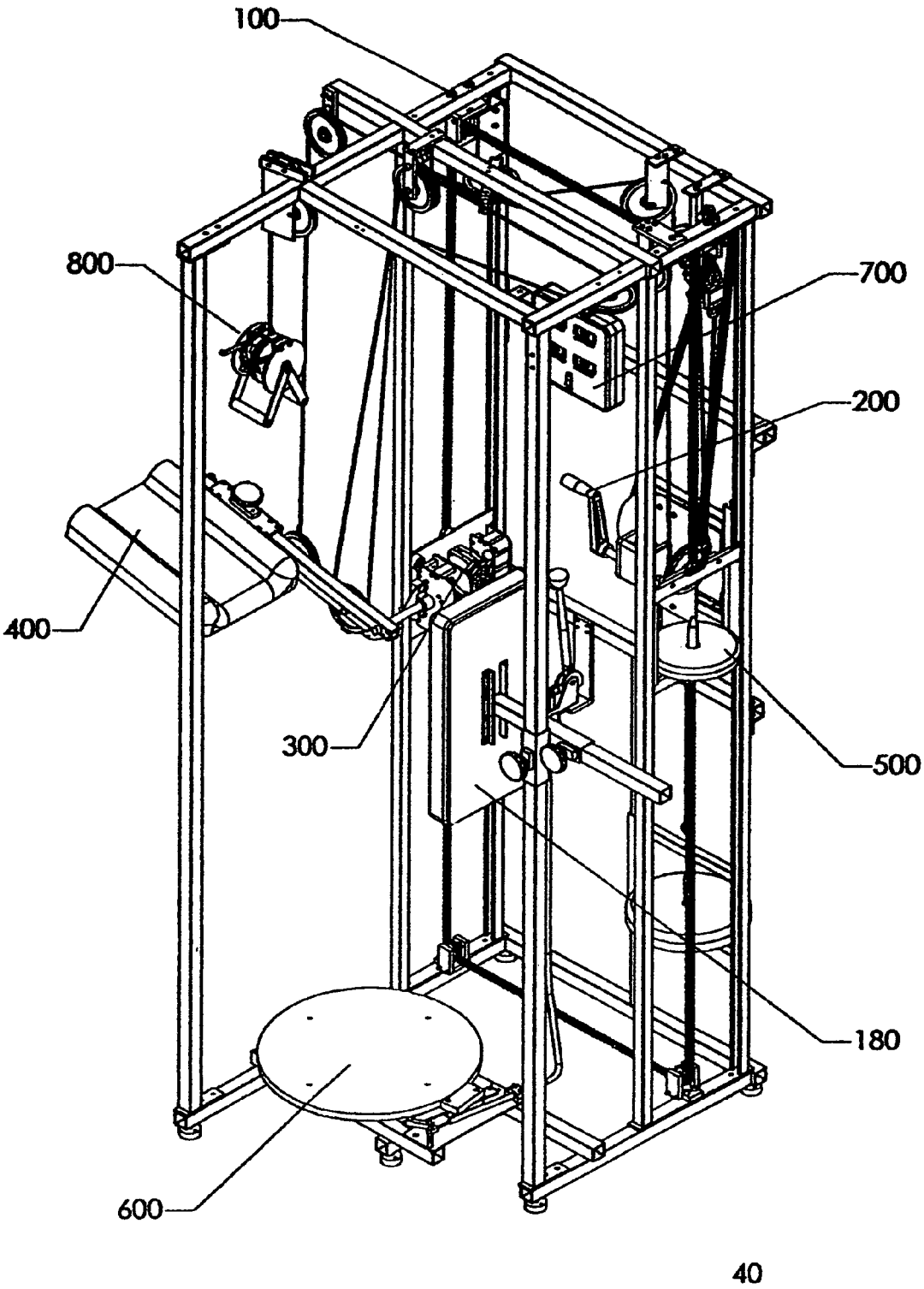
FIG. 1 is a perspective top-right-side view of a leg-stretching machine constructed in accordance with the invention, showing the entire stretching machine.
Figure 2:
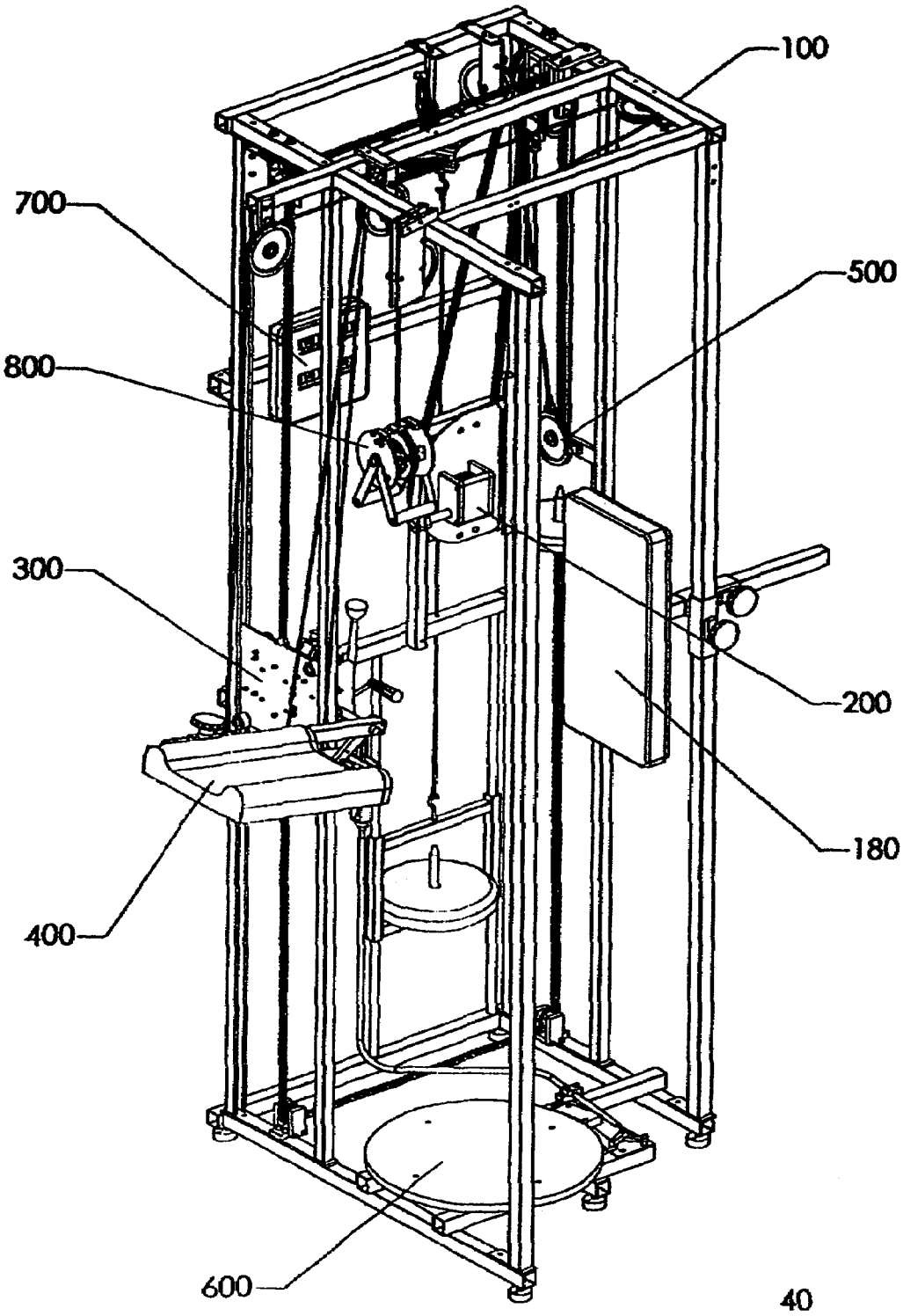
FIG. 2 is a perspective top-left-side view of the stretching machine of FIG. 1.

Referring now to the drawings, and initially to FIG. 1 and FIG. 2, there is depicted a muscle-stretching machine 40, constructed in accordance with a preferred embodiment of the present invention. As illustrated the muscle stretching machine 40 comprises eight subassemblies: frame 100, hand crank 200, leg lift 300, leg lift pad 400, slack cable pulley 500, turntable 600, central processor 700, and cable pull down 800. The back support sub subassembly 180 is an integral part of frame 100.

Figure 3:
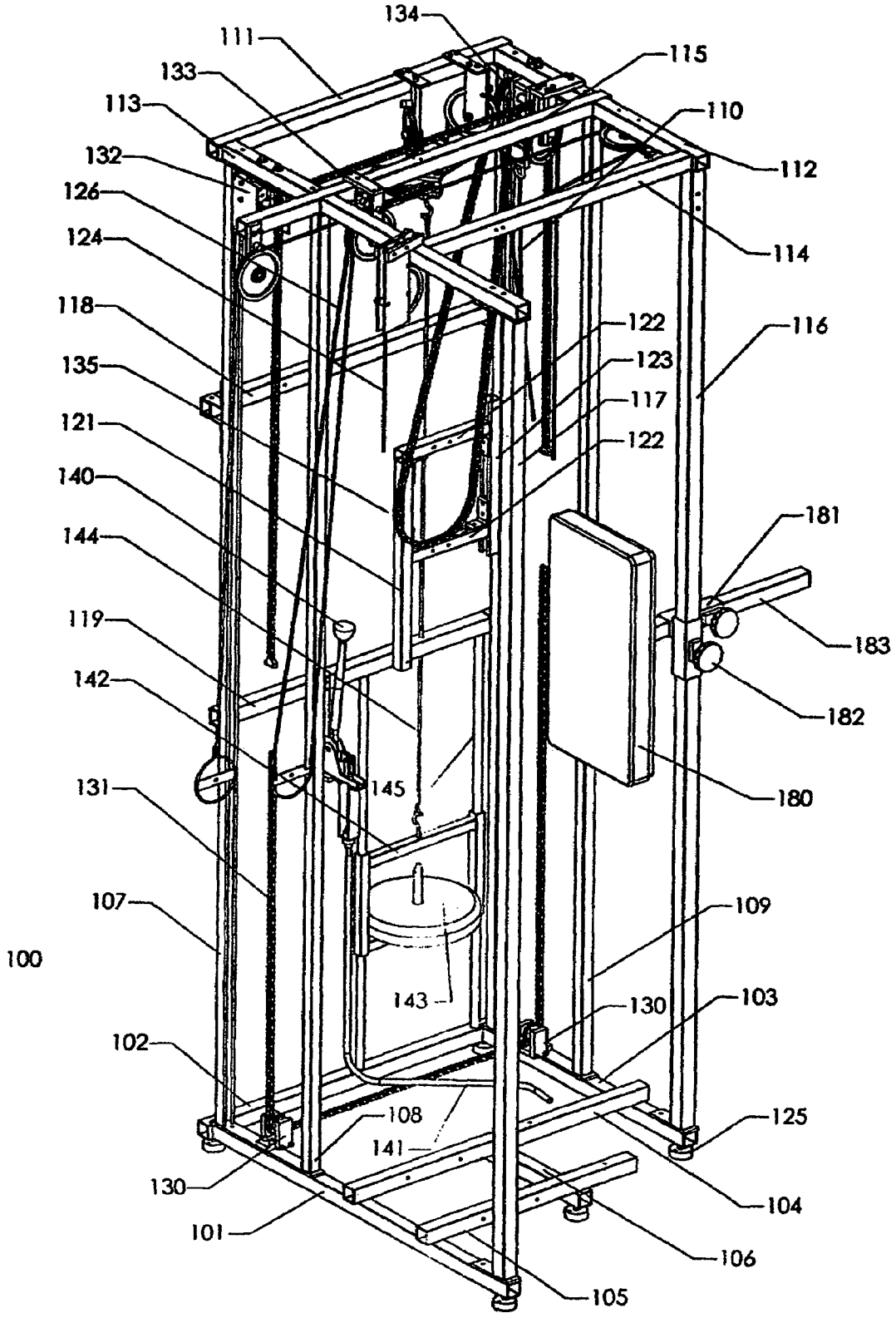
FIG. 3 is a perspective top-left-side view of the stretching machine of FIG. 1 with all the major subassemblies removed leaving the frame, pulley assemblies, sprocket assemblies, back support, weight stack, cables, and chains.
Figure 4:
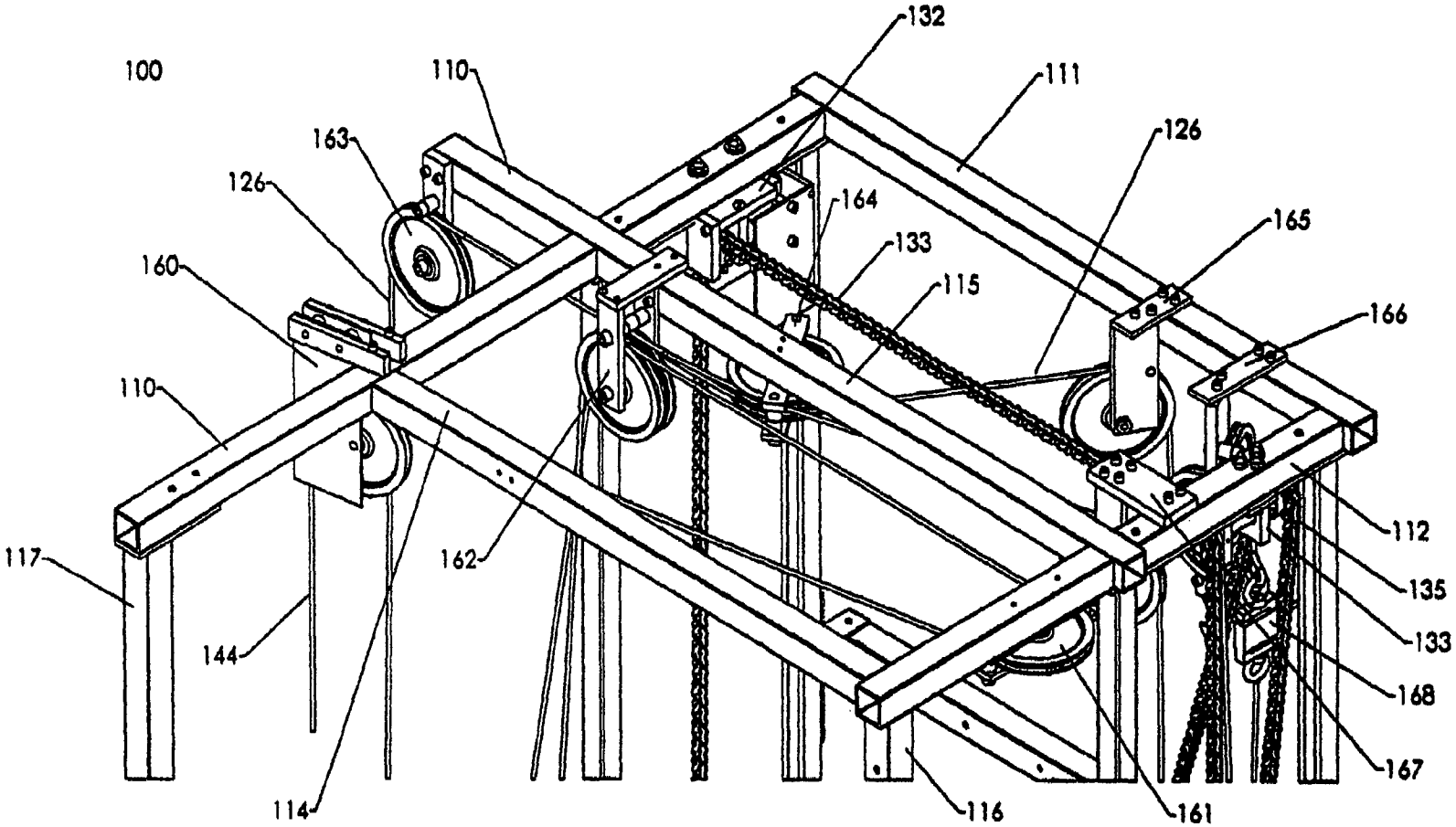
FIG. 4 is a top-right-side perspective view of the frame shown in FIG. 3 zoomed into the top half of the frame.
Figure 5:
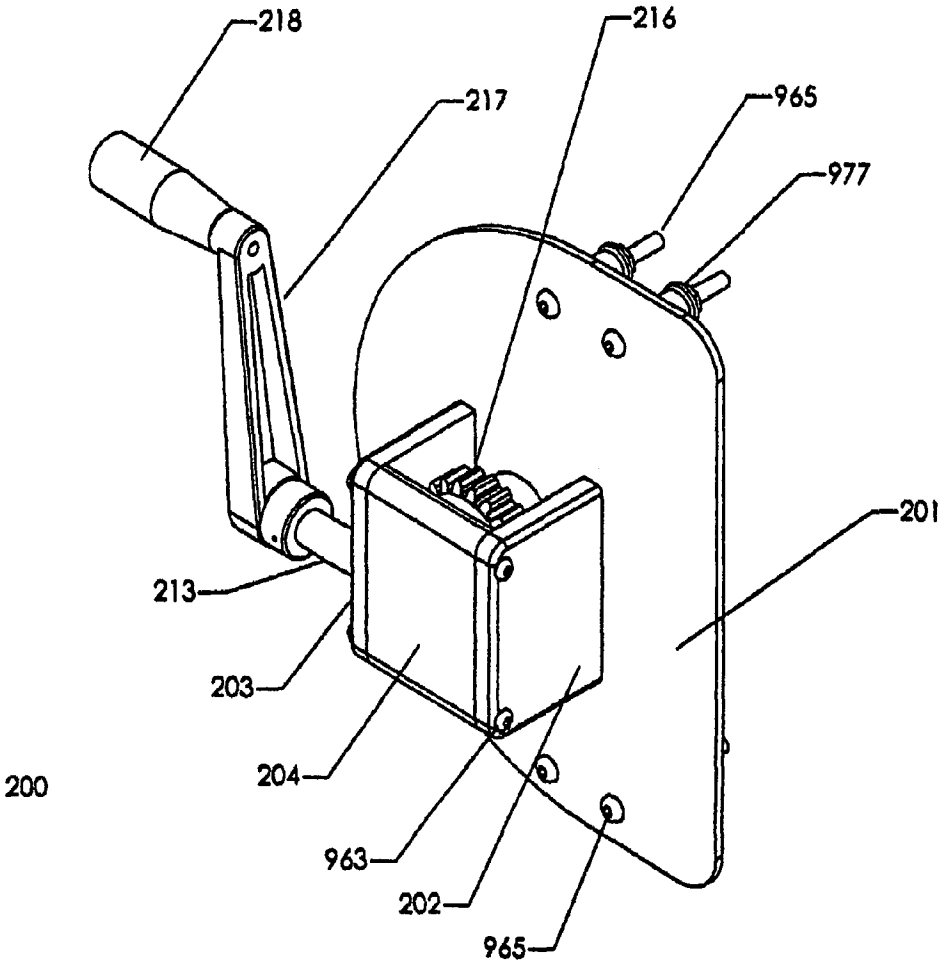
FIG. 5 is a perspective right-side view of the hand crank subassembly.
Figure 6:
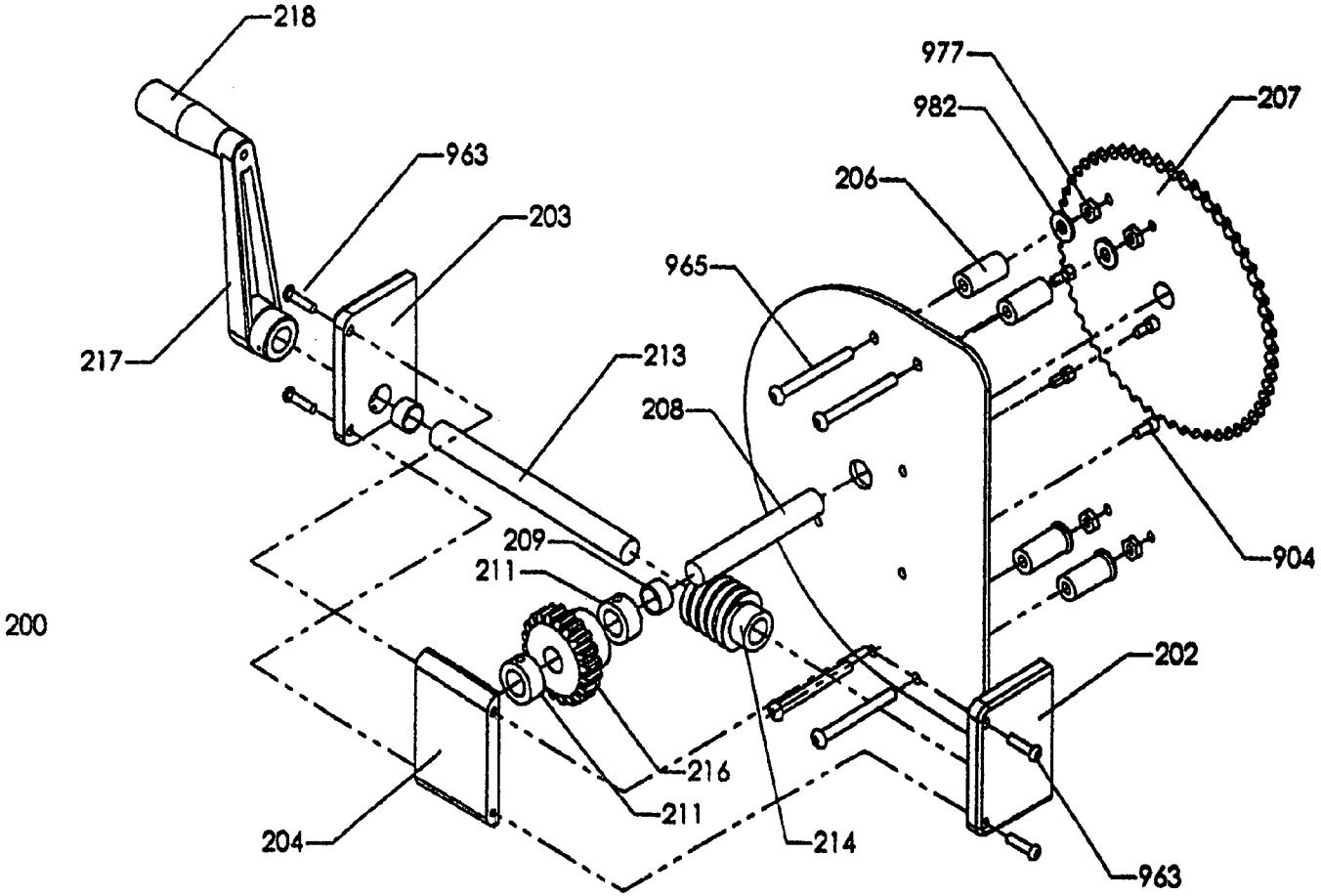
FIG. 6 is an exploded perspective right-side view of the hand crank assembly.
Figure 7:
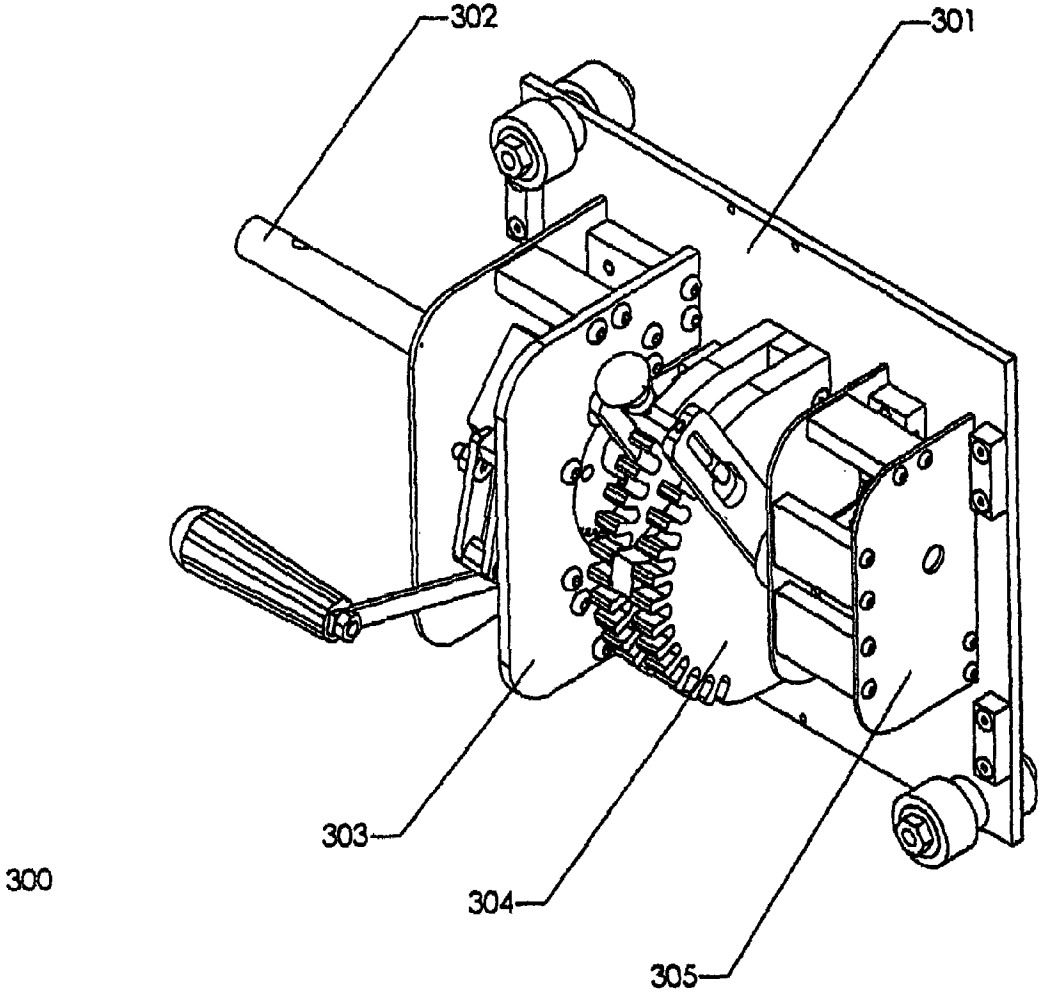
FIG. 7 is a perspective right-side view of the leg lift subassembly.

Referring now to FIG. 3 seven of the six subassemblies of the stretching machine 40 are removed except for the pieces comprising frame 100. This will allow for a clear description of the items comprising frame 100. Frame 100 comprises the combination of six vertical structural members 107, 108, 109, 110, 116, and 117; three horizontal bottom structural members 102, 104, and 105; three transverse bottom structural members 101, 103, and 106; three horizontal top structural members 111, 114, and 115; two transverse top transverse structural members 112, and 113; one horizontal central processor structural member 118, one horizontal weight stack structural member 119, two weight stack guides 145, one weight stack plate frame 142, four crank support structural members 121, 122, 122, and 123; and one back support structural member 183. All the structural members are rigid and of sufficient strength capable of supporting a person. The four vertical structural members 107, 108, 109, and 110 and the four crank support structural members 121, 122, 122, and 123 have 'U' shaped cross sections. All the remaining structural members have square tube cross-sections.

Referring both FIG. 2 and FIG. 3 the two left vertical structural members 107 and 108 accept the leg lift 300, and the two right vertical structural members 109 and 110 accept the slack pulley 500 into their "U" channels so that the lift 300 and the slack pulley 500 may travel up or down their respective vertical structural members. The vertical structural members 107, 108, 109, 110, 116, and 117 are of sufficient length so that a user may stand on the turntable 600, and have the cable pull down 800 just above their head.

Referring back to FIG. 3 the vertical structural members 107, 110, 116, and 117, each have a foot 125 attached to their lower end to support and level the frame 100. A foot 125 is also placed beneath one end of transverse bottom structural member 106. The length of structural members 101, 102, 103, 104, 111, 112, 113, 114, and 115 size the width and depth of the frame 100; so that the leg lift 300 and slack pulley 500 may function as described below without interference from the hand crank 200 and the central processor 700. The four crank support structural members 121, 122, 122, and 123 are cantilevered off of vertical structural support 110 and anchored to weight stack structural member 119. The four crank support structural members 121, 122, 122, 123 allow the crank to be mounted within the envelope of the frame 100, and at a height convenient for a typical user. Turntable 700 is attached to horizontal bottom structural members 104 and 105 of frame 100. Central processor structural member 118 is mounted to the two rear vertical structural members 107 and 110 so that the central processor 700 is mounted near eye level for most users. The two top transverse structural members 112 and 113 mount to the top ends of vertical structural members 107, 108, 109, 110, 116, and 117 so that their rear ends are flush with the two rear vertical surfaces of structural members 107 and 110 and their front ends are flush with the two front vertical surfaces of structural members 116 and 117 so as to locate the top horizontal structural member 114 directly overhead the user.

Two roller chain sprockets 130 are mounted to the top surfaces of the two transverse bottom structural members 101 and 103. Encoder/roller chain sprocket 132 is mounted to the bottom surface of the transverse top structural member 113. A roller chain double sprocket 115 is mounted to the bottom surface of the transverse top structural member 112. These four sprockets allow for the interconnection of the leg lift 300 to the slack pulley 500 via roller chain 131 and roller chain 133. The roller chain double sprocket 115 accepts a third roller chain 135 from hand crank 200. Roller chain 135 transmits the user rotational input from the hand crank 200 and changes the positions of the lift 300 and slack pulley 500.

Referring to FIG. 1, FIG. 2, FIG. 3 and FIG. 4 the function of the two cables 124 and 126, are described in detail. The cable pull down 800 is attached to one end of cable 124. Cable 124 is routed up to handle pulley 160, around horizontal pulley 161, to lift pulley 162, down to the leg lift pad 400, back up to the lift pulley 162, around a portion of horizontal pulley 164, to top vertical slack pulley 167, down to the slack cable pulley subassembly 500, and back up to load cell 168. Referring to FIG. 1 and FIG. 2, when the cable pull down 800 is pulled down by the user leg lift pad 400 is raised. Load cell 168 senses the amount of force required to raise leg lift pad 400, and transmits this signal to the central processor 700. The central processor processes this signal and displays it as the force in pounds. The leg lift pad 400 has one end of cable 126 fastened to it. Cable 126 is routed up to counter weight pulley 163, around horizontal pulley 164, to weight stack pulley 165, down to weight stack 142, back up to a second weight stack pulley 166, and down to slack cable subassembly pulley 500. Referring to FIG. 1 and FIG. 2, when the cable pull down 800 is pulled down leg lift pad 400 is raised. Because of the large amount of force required to raise leg lift pad 400 a counter balance force is applied to pad 400. This counter balance force is transmitted to the leg lift pad 400 from weight stack 142 by cable 126.

Referring to FIG. 1, FIG. 2, FIG. 3, FIG. 5, and FIG. 6 the hand crank 200 is a gear and sprocket assembly for raising and lowering the pivot point of rotation of leg lift pad 400. Sprocket plate 201 is attached to structural members 121, 122, 122, and 123, and spaced off of them by the use of crank spacers 206 screw 965, washer 982, and nut 977. Sprocket plate 201 accepts right plate 202, left plate 203, and center plate 204 as shown. Shaft 208 is mounted through sprocket plate 201 and into center plate 204. Worm gear 216 is inserted onto shaft 208 and held in place by shaft clamps 211. Shaft bearing 209 inserted into shaft plate 201 and allows shaft 208 to rotate. Sprocket 207 is fastened to the end of shaft 208. Shaft 213 is mounted through left plate 203 and into right plate 202. Worm 214 is inserted onto shaft 213 and held in place by engaging the teeth of worm gear 216. A second shaft bearing 209 inserted into left plate 203 and allows shaft 213 to rotate. Shaft crank 217 is pressed onto the end of shaft 213 and crank handle 218 is mounted to shaft crank 217. Left plate 203 and right plate 202 are fastened to center plate 204 by screw 963. Shaft plate 201 is fastened to left plate 203 and right plate 202 by screw 904. When handle 218 is rotated by the user, worm 214 rotates, this rotates worm gear 216, which rotates sprocket 207, which rotates a plurality of sprockets and roller chains, thereby changing the height of the pivot point of rotation for leg lift pad 400. The worm 214 and worm gear 216 are sufficiently sized to act as a brake when the handle 218 is not rotated and the user exerts downward force on the pivot point of leg lift pad 400 rotation while stretching their leg. The sprocket 207 is sufficiently sized so that each complete rotation of handle 218 changes the height of the pivot point of pad 400 rotation a convenient increment of measure.

Figure 8:
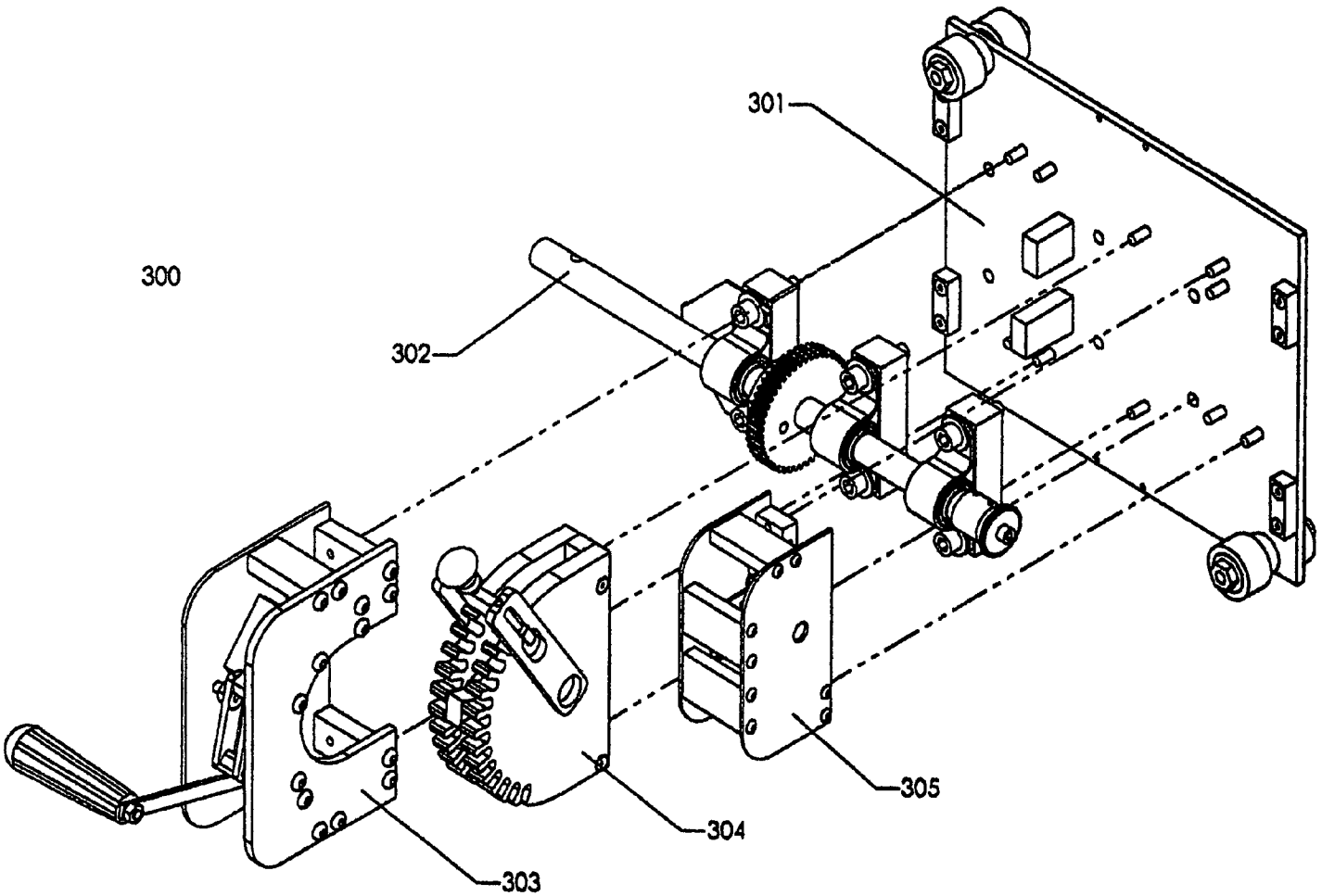
FIG. 8 is an exploded perspective right-side view of the leg lift subassembly.
Figure 9:
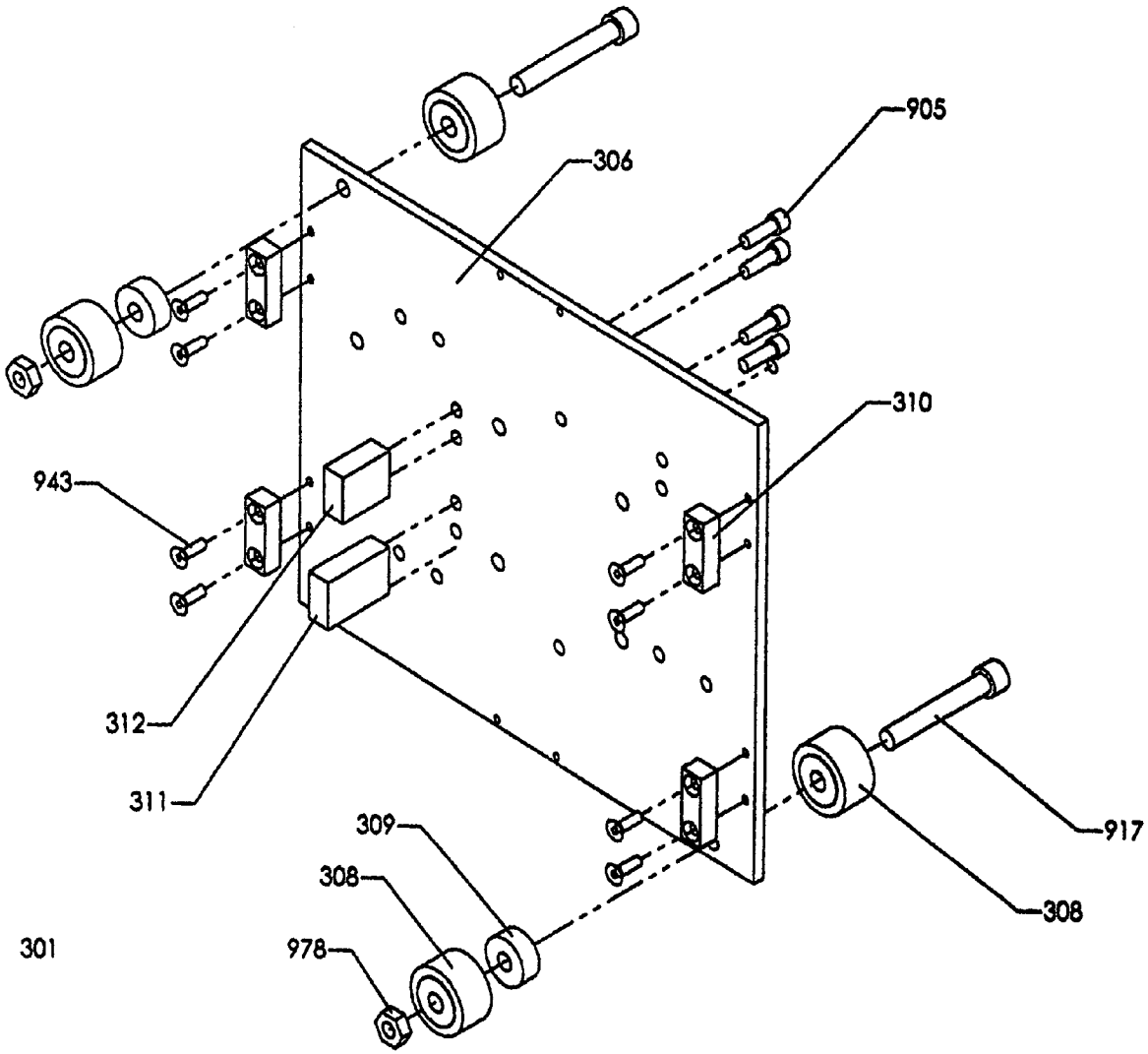
FIG. 9 is an exploded perspective right-side view of the plate sub subassembly.
Figure 10:
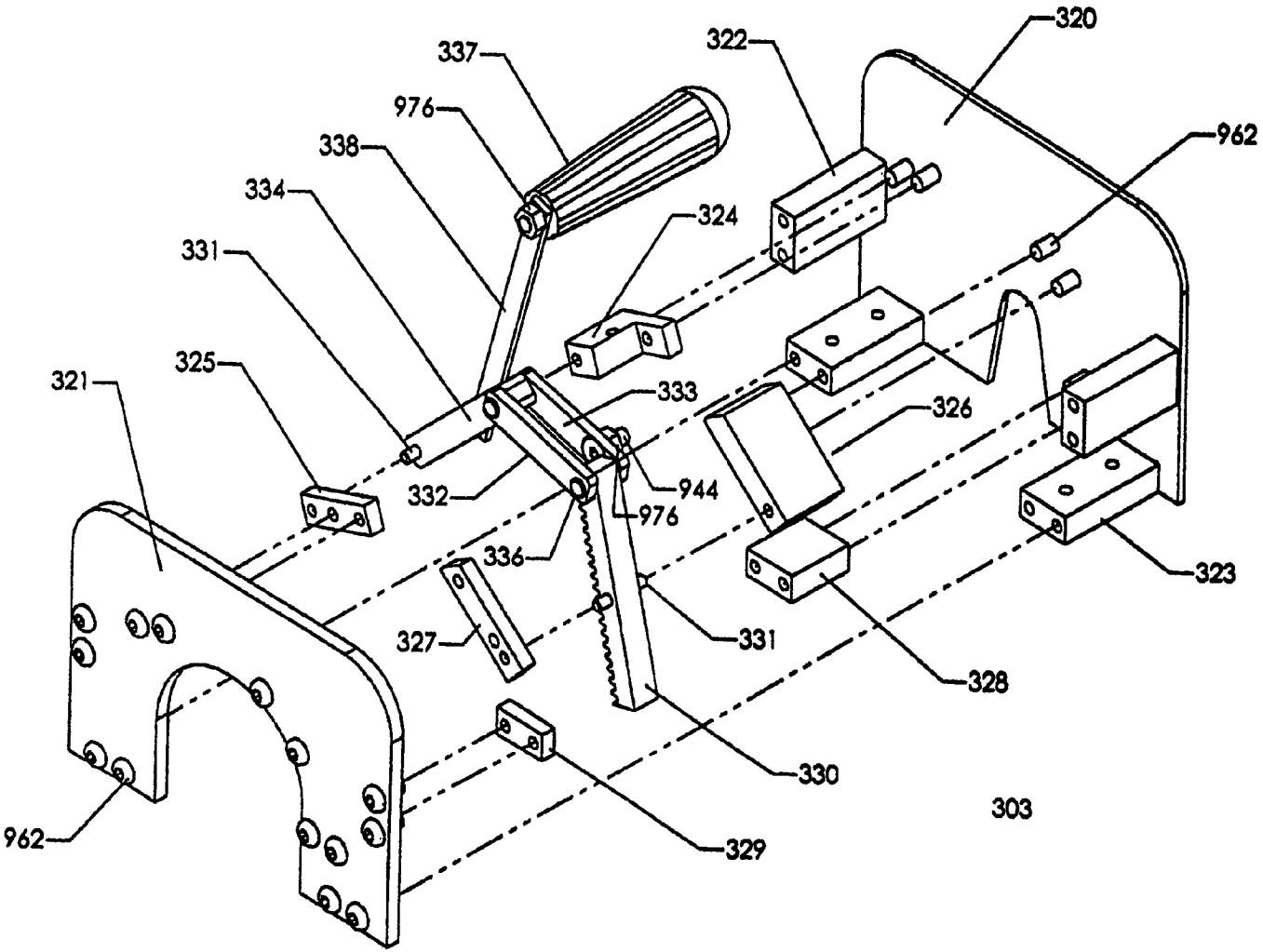
FIG. 10 is an exploded perspective right-side view of the brake sub subassembly.
Figure 11:
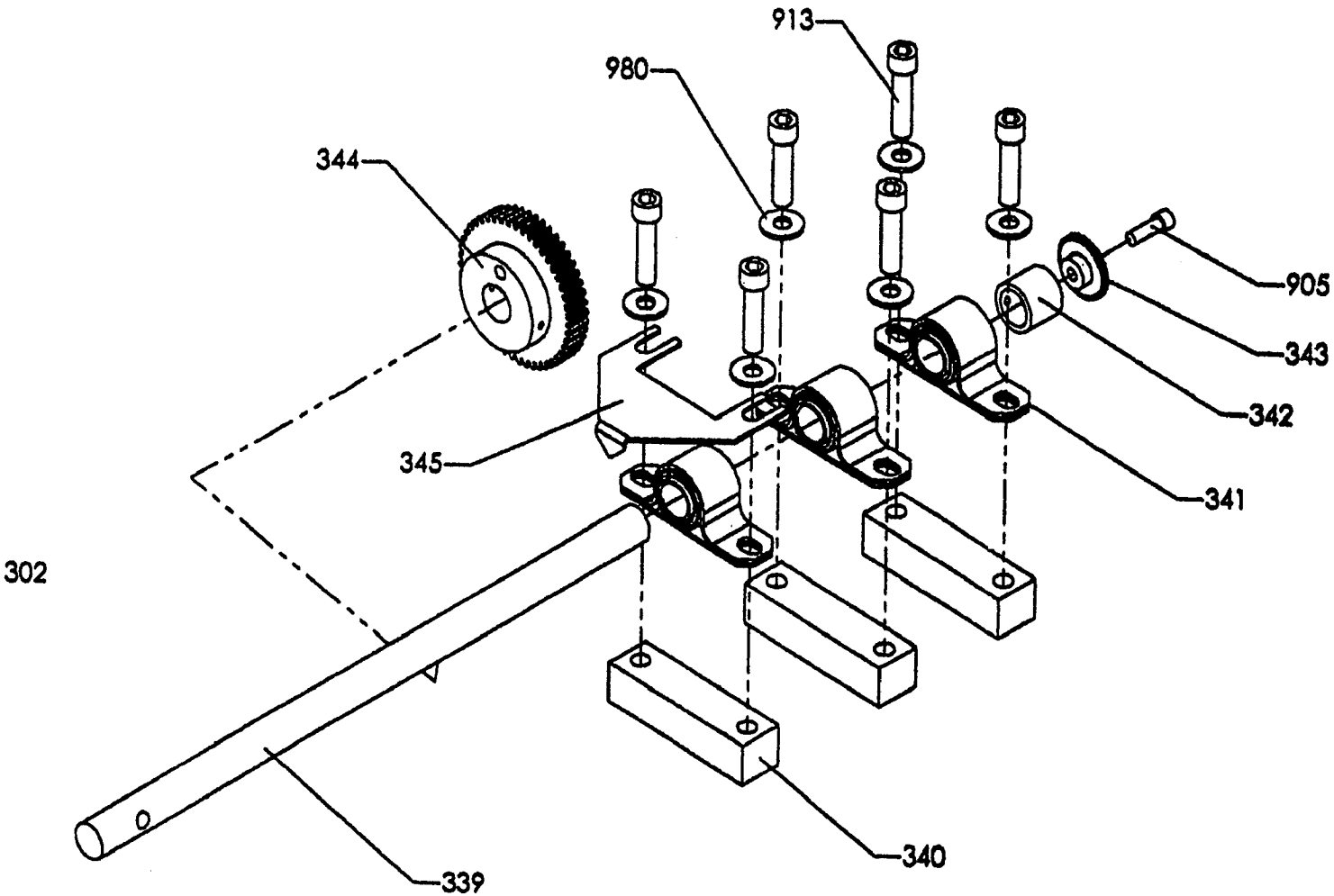
FIG. 11 is an exploded perspective right-side view of the shaft sub subassembly.
Figure 12:
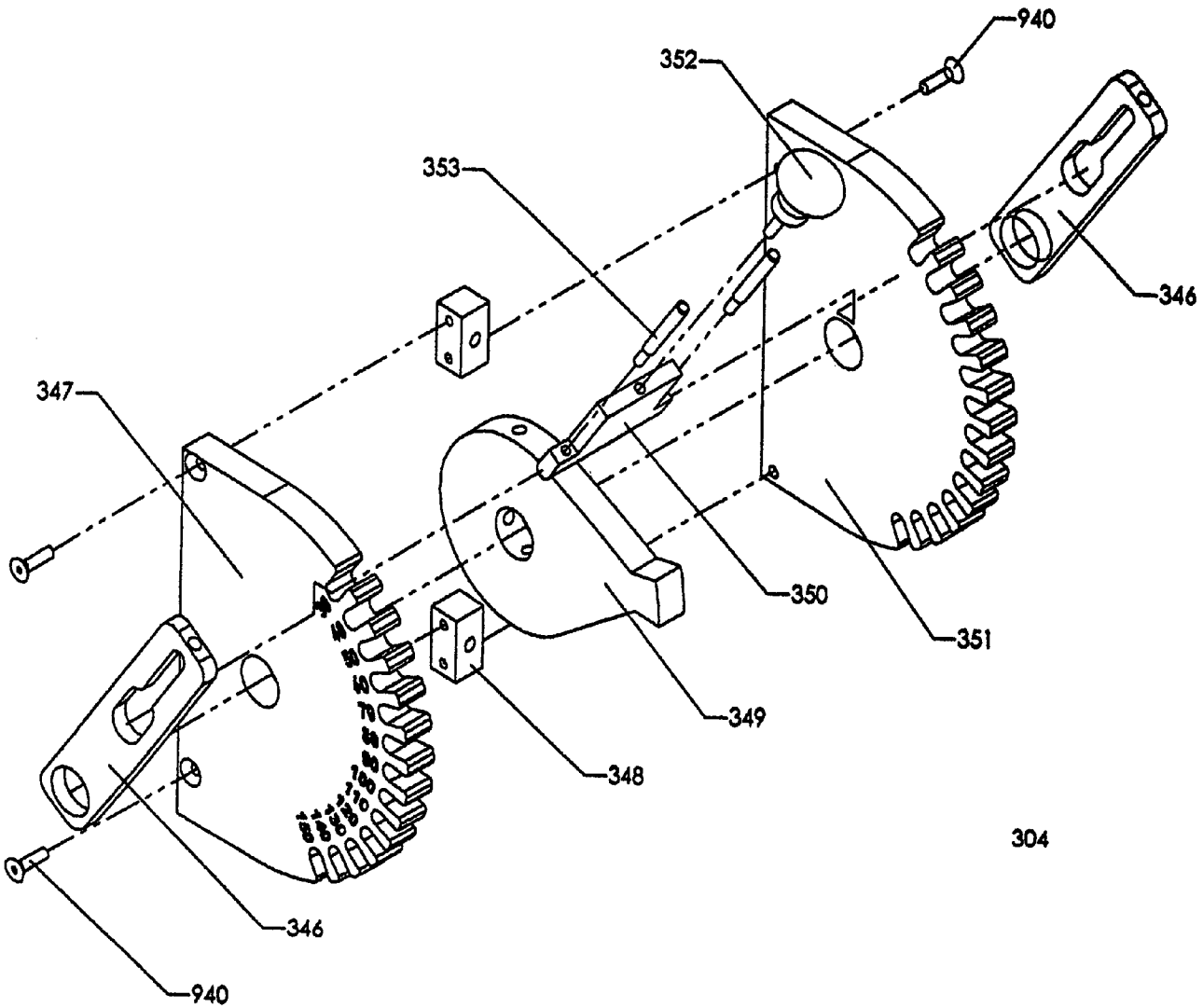
FIG. 12 is an exploded perspective right-side view of the upward stop sub subassembly.
Figure 13:
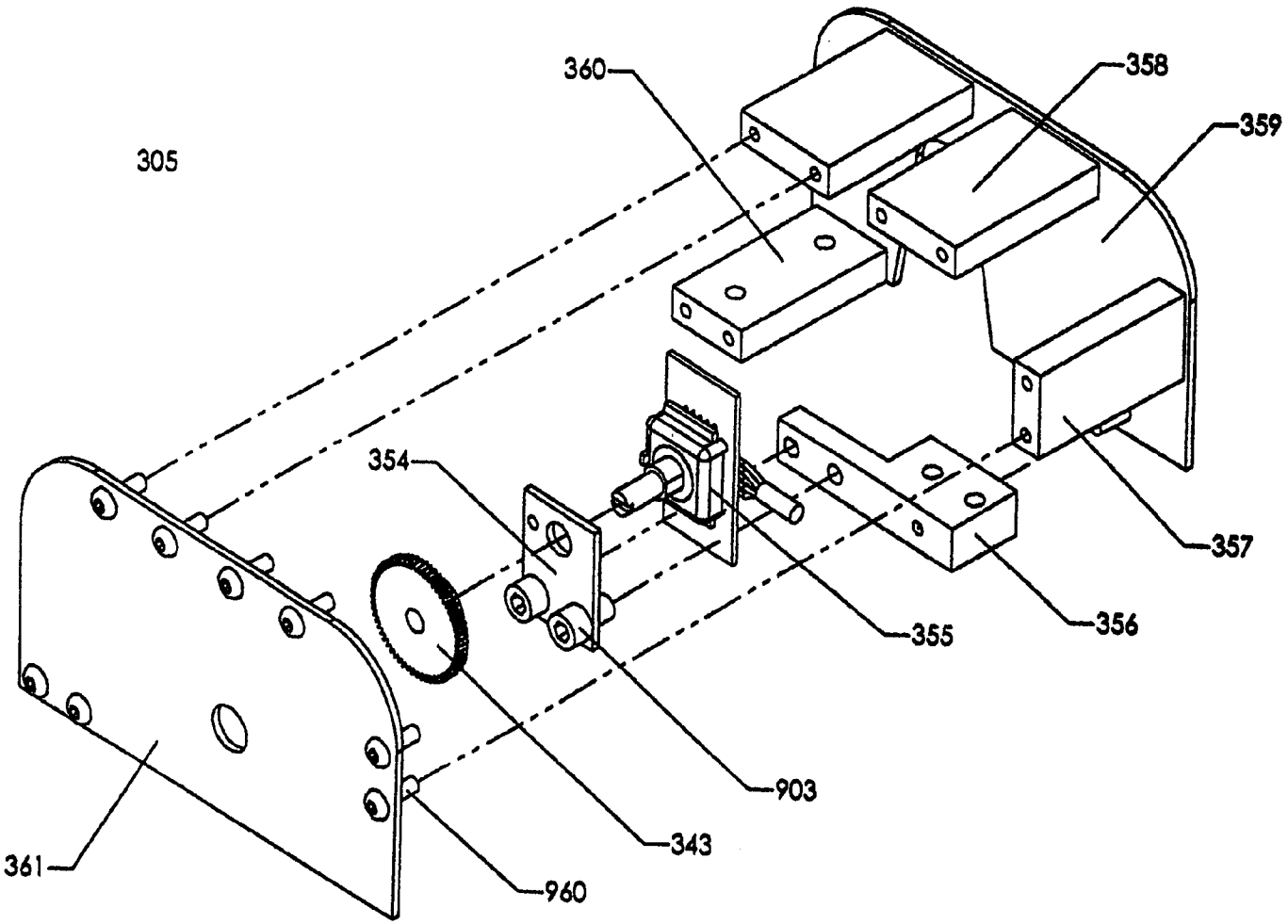
FIG. 13 is an exploded perspective right-side view of the encoder sub subassembly.
Figure 14:
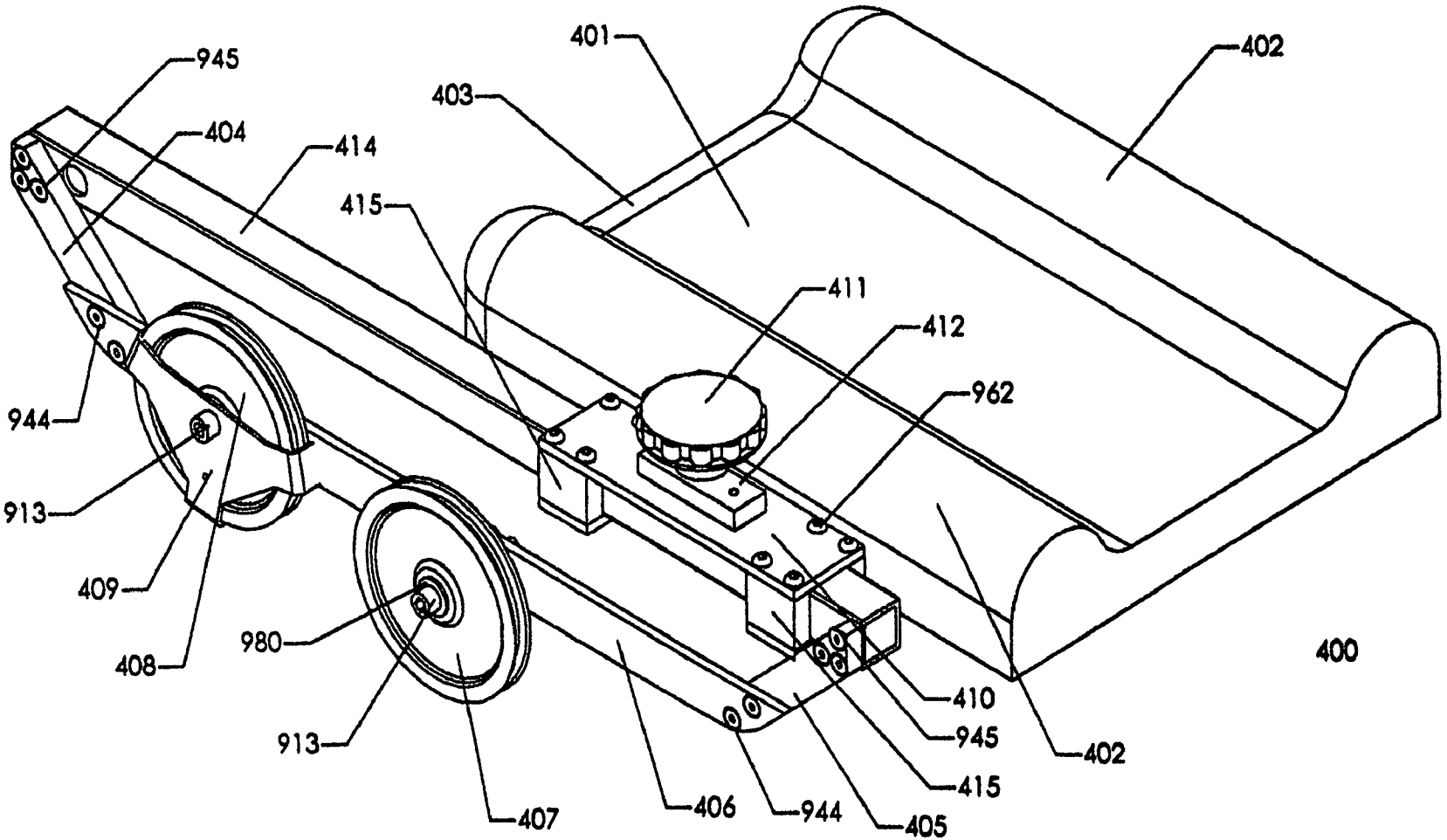
FIG. 14 is a perspective rear-side view of the leg lift pad subassembly.
Figure 15:
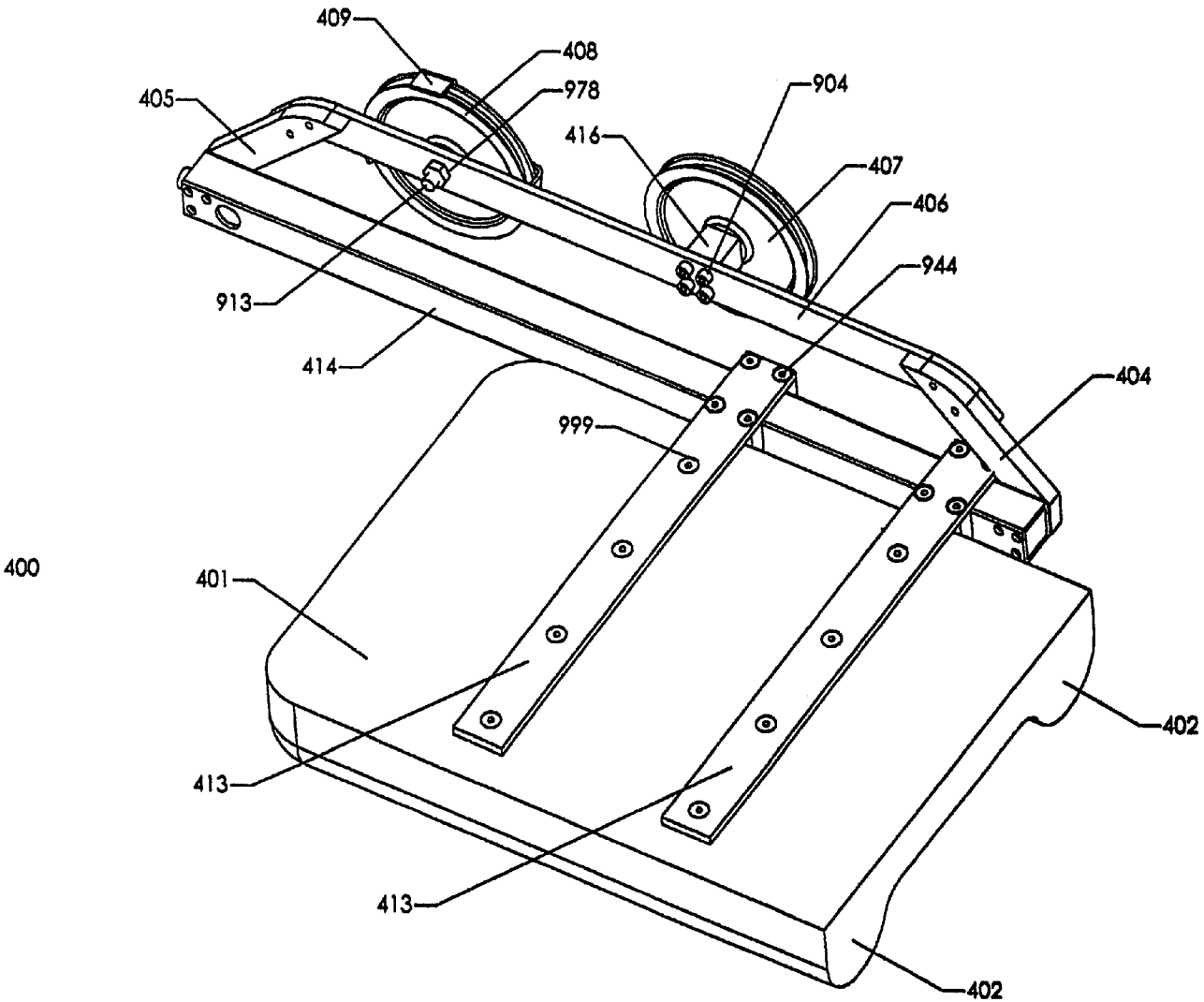
FIG. 15 is a perspective bottom-side view of the leg lift pad subassembly.
Figure 16:
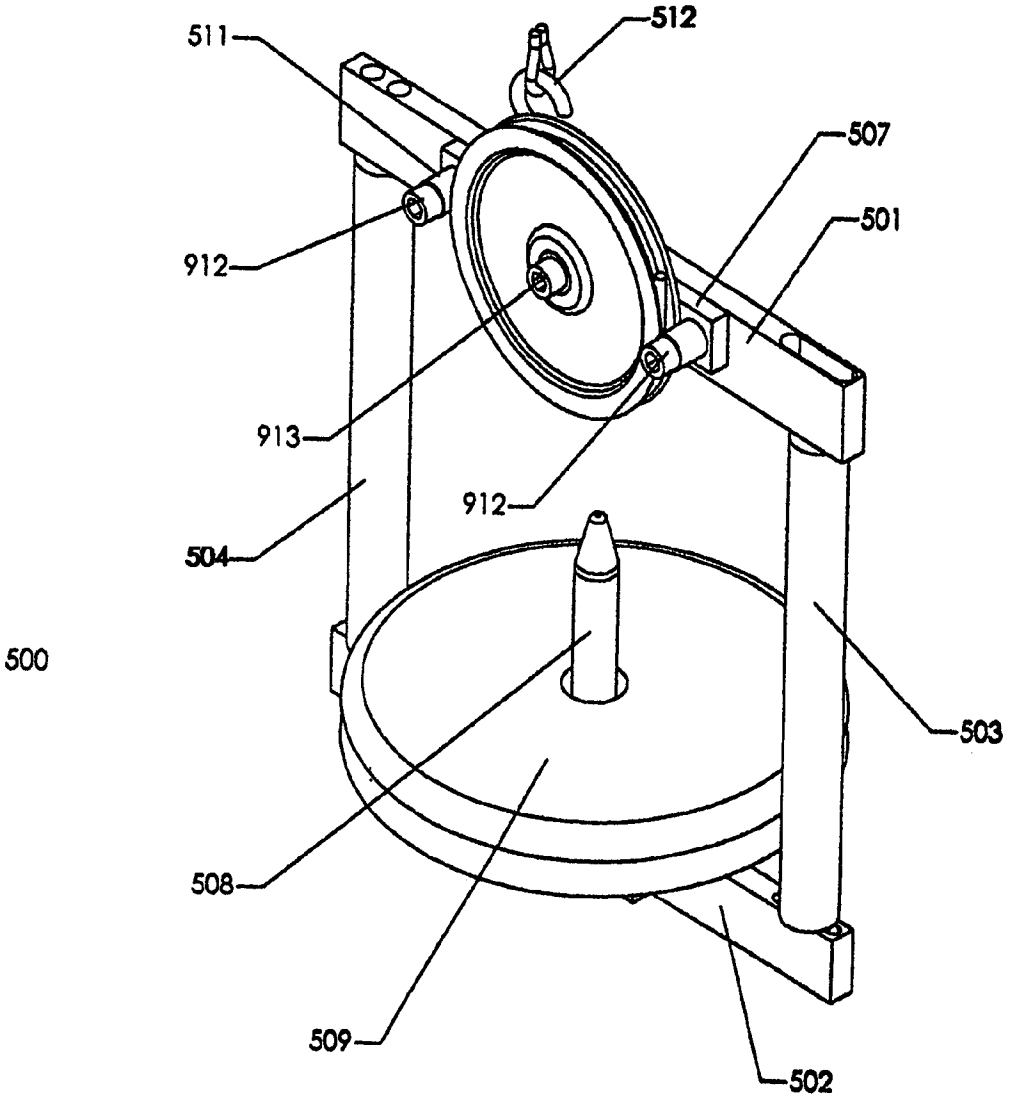
FIG. 16 is a perspective left-side view of the slack cable subassembly.
Figure 17:
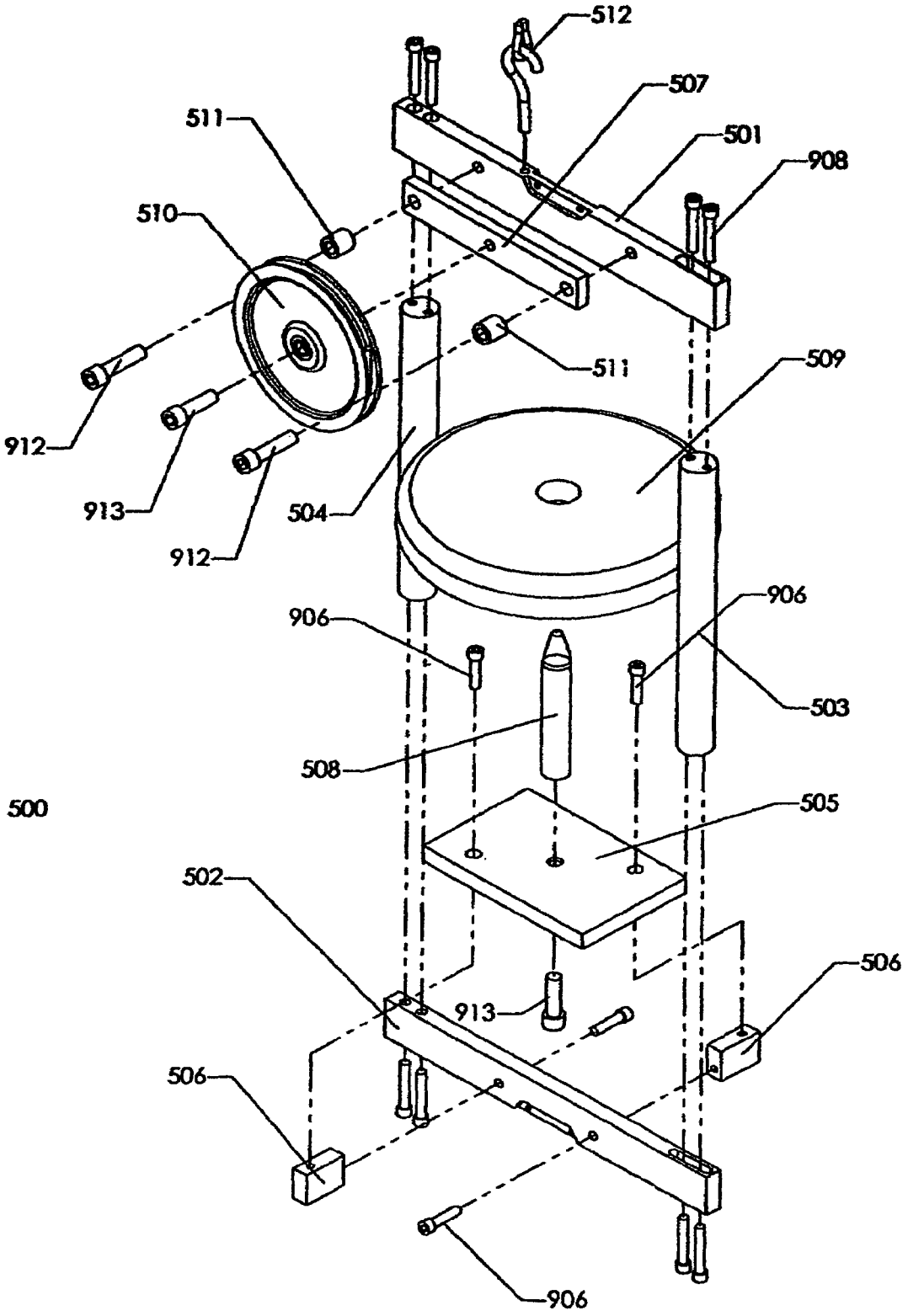
FIG. 17 is an exploded perspective left-side view of the slack cable subassembly.
Figure 18:
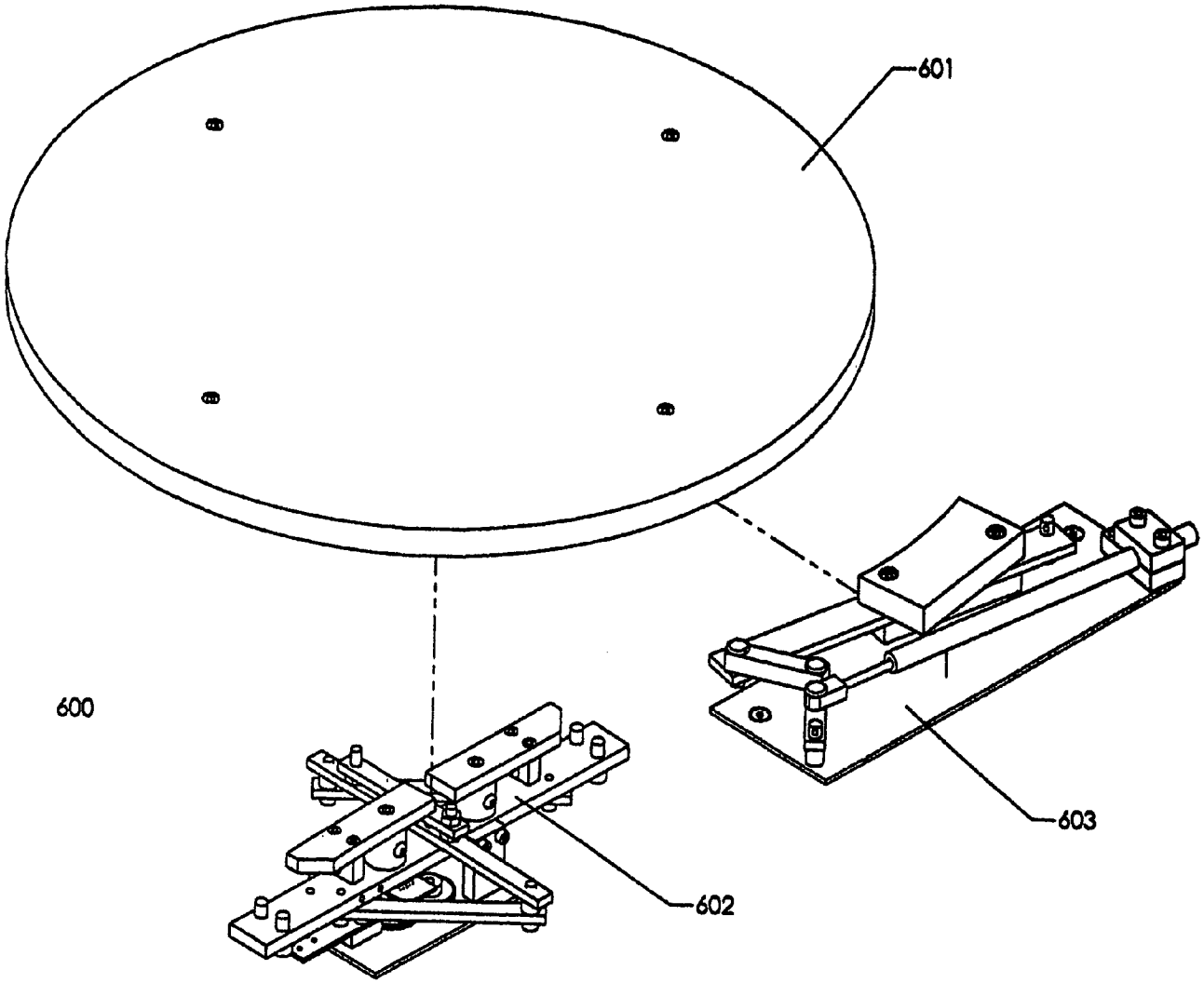
FIG. 18 is an exploded perspective top-right-side view of the turntable subassembly.

Refer now to FIG. 1, FIG. 2, FIG. 7, FIG. 8 FIG. 9, FIG. 10, FIG. 11, FIG. 12, and FIG. 13 for a detailed description of leg lift 300. Leg lift 300 is made up five sub subassemblies: plate sub subassembly 301, shaft sub subassembly 302, brake sub subassembly 303, upward stop sub subassembly 304, and encoder sub subassembly 305. Referring to FIG. 9 the plate sub subassembly 301 consists of a plate 306; roller bearings 308, channel spacers 310, bottom stop 312, and top stop 311. The roller bearings 308 are fastened into opposite corners using screw 917, spacer 309, and nut 978. The four channel spacers 310 are fastened to opposite sides of plate 306 by screw 943. The top stop 311 and the bottom stop 312 are fastened to plate 306 by screw 905. The roller bearings 308 located in opposite corners of plate 306, and the channel spacers 310 allow the leg lift 300 to travel up and down vertical structural members 107 and 108 while remaining centered between them. The top center of plate sub subassembly 302 is fastened to roller chain 133. The bottom center of plate sub subassembly 302 is fastened to roller chain 131. The top stop 311 prevents the leg lift pad 400 from rotating past 180 degrees and into the users face. The bottom stop 312 prevents the lift pad 400 from rotating past 0 degrees and into the users shin. Referring to FIG. 10 the brake sub subassembly 303 is made up of brake plate 320, brake plate 321, two plate spacers 322, two plate spacers 323, toggle guide 324, toggle guide 325, rack guide 328, rack guide 329, rack 330, toggle link 332, toggle link 333, toggle link 334, pin 336, handle 337, and arm 338. The plate spacers 322 and 323 hold the plates 320 and 321 a fixed distance apart to allow the toggle assembly consisting of rack 330, toggle link 332, toggle link 333, and toggle link 334 to freely toggle up and down. The plates 320 and 321 are fastened to spacers 322 and 323 by the use of screws 962. Pin 331 is inserted into toggle link 334, which allows toggle link 334 to pivot on toggle guide 324 and toggle guide 325. A second pin 331 is inserted into rack 330, which allows rack 330 to pivot on rack guide 328 and rack guide 329. Toggle link 332 and toggle link 333 connect to the ends of toggle link 334 and rack 330 by the use of pins 336. Arm 338 is fastened to toggle link 334. The handle 337 is fastened to arm 338 and locked in place by nut 976. When the user wishes to stop the movement of the leg lift pad 400, the handle is pushed in the direction of rack 330, which causes the rack 330 to pivot and engage gear 344 on shaft sub subassembly 302 (FIG. 11), rack 330 is held in place by the toggle action of the toggle assembly, thereby braking the movement of leg lift pad 400. When the user wishes to resume the movement of the leg lift pad 400, the handle is pulled away from the rack 330, releasing the toggle, and disengaging the rack 330 from the gear 344 on shaft sub subassembly 302 (FIG. 11). Now referring to FIG. 11 the shaft sub subassembly 302 consists of a shaft 339, three shaft bearings 341, three shaft bearing supports 340, a gear 344, a height pointer 345, a gear coupler 342, a gear 343, and fastening hardware. The shaft 339 accepts the gear 344 oriented as shown, then two shaft bearings 341 are placed on shaft 339 on either side of gear 344. The third shaft bearing 341 is placed on the shaft 339 and located near the end of the shaft with gear coupler 342 and gear 343. A gear coupler 342 is pressed into the far end of shaft 339. The gear coupler 342 accepts gear 343, which is held in place by screw 905. Referring to FIG. 8 and FIG. 11 the shaft sub subassembly 302 is fastened to the plate sub subassembly 301 by the use of screw 913 and washer 980. The end of shaft 339 opposite the gear 343 and gear coupler 342 accepts the leg lift pad 400. Referring now to FIG. 12 the upward stop sub subassembly 304 consists of slotted plate 347, slotted plate 351, stop block 349, catch guides 346, catch 350, catch pins 353, knob 352, mount blocks 348, and fastening hardware. The slotted plate 347, the slotted plate 351, the stop block 349, and the two catch guides 346 are all placed on shaft 339 of shaft sub subassembly 302 between two bearings 341. The slots in slotted plate 347 are kept in perfect alignment with the slots with slotted plate 351 by the use of mount blocks 348 and screws 940. Mount blocks 348 also fasten the upward stop sub subassembly to the plate sub subassembly 301. The knob 352 is threaded to catch 350. The catch pins 353 are fastened into catch 350 in such a way that they are captive inside the catch guides 346 and allow catch 350 to slide in and out of the slots in the two slotted plates 347 and 351. It is important that a first time user of this invention does not hurt their self by over stretching their leg. The first time user will therefore set the catch 350 at or near the lowest setting on the upward stop sub subassembly 304. The first time user then may increase the leg stretch in 10 degree increments until they are at their maximum leg stretch level. An experienced user of this invention may not want to hit an upward stop and therefore may place the catch 350 so that it remains out of the slots, which turns off the upward stop. Referring now to FIG. 13 the encoder sub subassembly is made up of encoder plate 359, encoder plate 361, spacer plate 357, wide spacer plates 358; mount plate 360, encoder 355, encoder mount plate 356, encoder bracket 354, gear 343, and fastening hardware. Encoder plate 359 and 361 are attached to spacer plate 357, wide spacer plate 358, and mount plate 360 using screw 960. Encoder mount plate 356 is fastened to encoder plate 359, and the encoder bracket 354 is fastened to the encoder mount plate 356 by the use of screws 903. The gear 343 is pressed onto the shaft of encoder 355. The mount plate 360 and encoder mount plate 356 attach the encoder sub subassembly to the plate sub subassembly 301. The encoder sub subassembly 305 is mounted to the plate sub subassembly 301 so that the gear 343 of the encoder sub subassembly 305 meshes with the gear 343 of the shaft sub subassembly 302. When the leg lift pad 400 is raised it rotates the shaft 339 of shaft sub subassembly 302, which rotates the gear 343 on encoder 354. The rotation of encoder 354 transmits an electrical signal to the central processor 700, which processes this signal and displays it as the leg lift angle. Refer now to FIG. 1, FIG. 2, FIG. 14, and FIG. 15 for a detailed description of the leg lift pad 400. A compressible, resilient material covered with a cloth type surface in a shape, which allows it to cradle and support a user's leg, comprises the leg lift pad 401. Leg pad 401 has raised sides 402, which prevent the user's leg from slipping off of leg pad 401. A lead in radius 403 is provided on leg pad 401 for the comfort of the user. A top angle bracket 404, bottom angle bracket 405, pulley bar 406, counter weight pulley 407, lift pulley 408, cap 409, bar plate 410, knob 411, thread plate 412, pad bars 413, tube 414, bar brackets 415, counter weight pulley spacer 416, and fastening hardware all are required in the construction of leg lift pad 400. The pad bars 413, bar brackets 415, and the bar plate 410, are fastened into two square openings in which the tube 414 freely slides. Screw 962 is used to fasten together the two square openings. The top angle bracket 404 and the bottom angle bracket 405 fasten to the ends of tube 414 by the use of screw 945 and keep the tube 414 captive into the two square openings. The other ends of top angle bracket 404 and bottom angle bracket 405 accept a pulley bar by the use of screw 944. The pulley bar 406 accepts lift pulley 408 and counter weight pulley spacer 416. Screw 913 and nut 978 attaches lift pulley 408 to pulley bar 406. Screw 904 attaches counter weight pulley spacer 416 to pulley bar 406. Screw 913 attaches counter weight pulley 407 to counter weight pulley spacer 416. Lift pulley 408 has a cap 409 placed over it to keep lift cable 124 captive on lift pulley 408. A thread plate 412 is mounted to the topside of bar plate 410. A knob 411 is threaded into thread plate. Pad 401 is fastened to pad bars 413 by the use of screw 944 and screw 999. The end of shaft 339 on leg lift 300, opposite the end with the rotary encoder sub subassembly 305, is inserted into the hole in tube 414 and pinned in place. The user of this invention moves the pad 401 to their desired position by loosening knob 411, sliding the pad 401 up or down tube 414 and then re-tightening knob 411. Once pad 401 is locked in place the user places one leg onto pad 401, unlocks brake sub subassembly 303, pulls down on cable pull down 800, which pulls lift cable 124 and lifts the leg, while counter weight cable 126 transmits additional lifting force to lift the leg by pulling up on counter weight pulley 407.

Now refer to FIG. 1, FIG. 2, FIG. 16, and FIG. 17 for a detailed description of slack cable pulley 500. The slack cable pulley 500 is slidably attached to the two right vertical structural members 109 & 110 of frame 100. The slack cable pulley 500 is made up of the following components: top chain bar 501, bottom chain bar 502, guide rod 503, guide rod 504, pin plate 505, gusset 506, spacer plate 507, pin 508, weights 509, pulley 510, cable bushing 511, cable hook 512, and fastening hardware. Guide rod 503 and guide rod 504 are attached to top and bottom chain bars 501 and 502 using screw 908. The gussets 506 attach to bottom chain bar 502 using screw 906. The pin plate 505 attaches to gussets 506 using screw 906. The pin 508 is fastened to plate 505 using screw 913. The pulley 510, cable bushings 511, and the spacer plate 507 attach to top chain bar 501 using screws 912 and 913. The hook 512 screws into to the top of chain bar 501. The weights 509 are placed onto pin 508 just prior to using this leg-stretching machine. The slack pulley 500 serves two purposes. The first is to pay out or take up the lift cable 124 and the counter weight cable 126 as the user adjusts the pivot point of rotation of leg lift pad 400 either up or down. The second is to counter balance the combined weights of the leg lift 300 and the leg lift pad 400, so that when the user adjusts the pivot point of rotation it is a smooth and easy procedure in both upward and downward directions.

Figure 19:
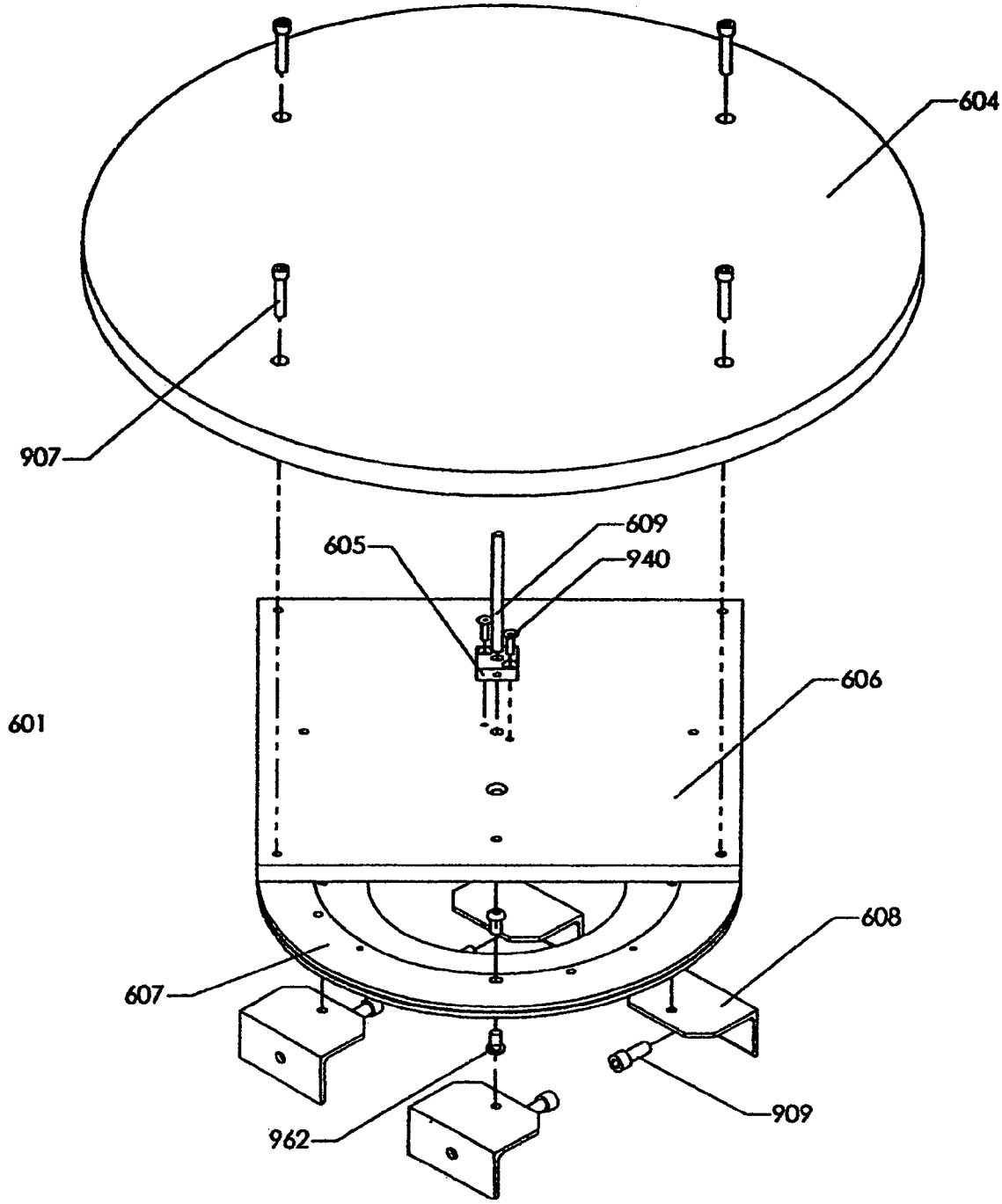
FIG. 19 is an exploded perspective right side view of the turntable footplate sub subassembly.
Figure 20:
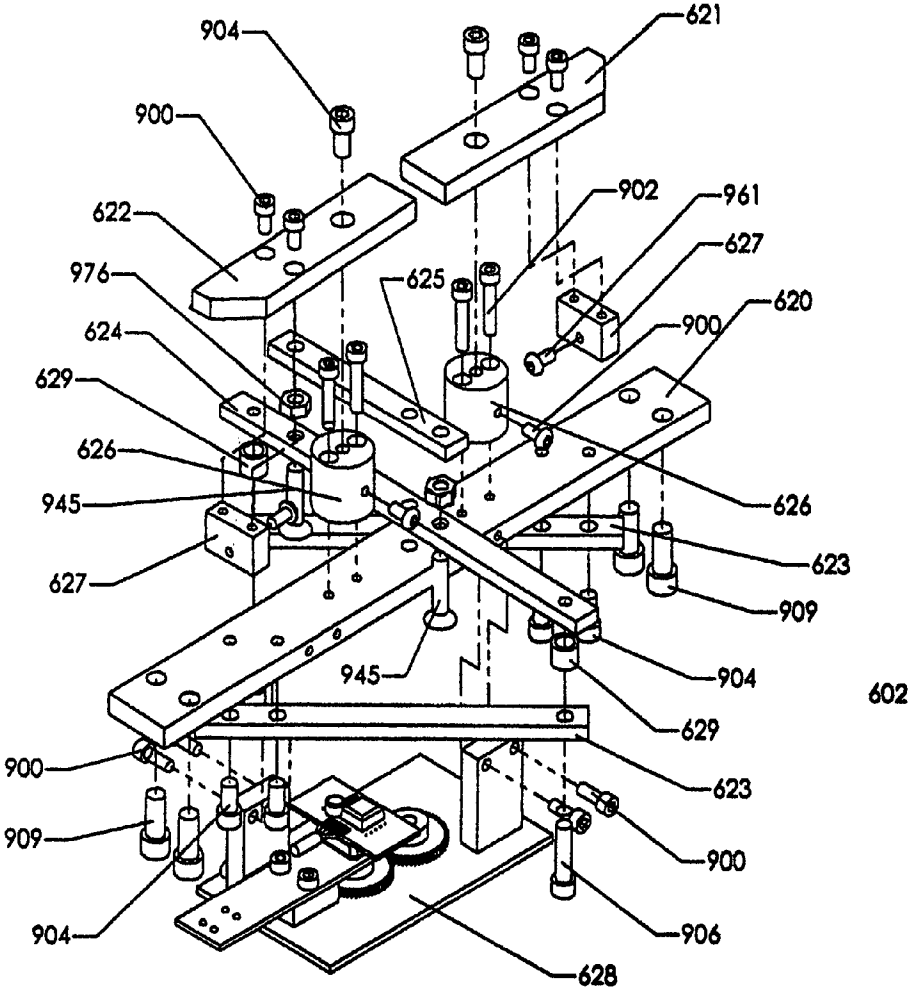
FIG. 20 is an exploded perspective right side view of the turntable spring sub subassembly.

Refer to FIG. 1, FIG. 2, FIG. 18, FIG. 19, FIG. 20, and FIG. 21 for a detailed description of turntable 600. The turntable 600 is made up of three sub subassemblies: footplate 601, spring 602, and brake 603. Referring to FIG. 19 the footplate sub subassembly 602 is made up of a round plate 604, pin lock 605, plate 606, bearing 607, bracket 608, pin 609, and fastening hardware. The pin lock 605 is fastened to plate 606 by screw 940. The pin 609 is pressed into the pin lock until the top surface of the pin 609 is flush with the top surface of the pin lock 605 and the pin extends a distance below bracket 608. Plate 606 is fastened to bearing 607 with screw 962. Bearing 607 is fastened to bracket 608 by screw 962, and four brackets 608 are fastened to horizontal bottom structural members 104 and 105 of frame 100. Round plate 604 is fastened to plate 606 with screw 907. The footplate sub subassembly 602 provides the user with a platform to stand on while using the muscle-stretching machine described herein. The footplate sub subassembly 602 is allowed to rotate either clockwise or counter clockwise. Now referring to FIG. 20 the spring sub subassembly 602 consists of the following items: spring encoder bar 620, right catch 621, left catch 622, pin bar support 623, pin bar 624, short pin bar 625, spring hub 626, spring lock 627, spring encoder 628, spacer 629, and fastening hardware. The pin bar 624, the short pin bar 625, and the pin bar supports 623 are all fastened to the spring encoder bar 620 using screws 904, 906, and 945; nut 976, and spacer 629. The two spring hubs 626 are fastened to the encoder spring bar 620 using screw 902. The right and left catch plates, 621 and 622, each attach to the top of a separate spring hub 626 using screw 904 in such a way that both may pivot CW and CCW atop the spring hubs 626. The inside end of a constant force spring (not shown) attaches to the spring hub 626, and the outside end of the constant force spring (not shown) attaches to the spring lock 627. Both ends of the constant force spring are fastened using screw 961. The first spring lock 627 is fastened to the underside of the right spring catch 621. The second spring lock 627 is fastened to the underside of the left spring catch 622. Both spring locks 627 are fastened using screw 900. The spring encoder 628 is fastened to the underside of the spring encoder bar 620 using screw 900. The spring sub subassembly 602 fastens to horizontal bottom structural members 104 and 105 of frame 100 using screw 909. The spring sub subassembly accepts the pin 609 from the footplate sub subassembly. The pin 609 passes through the center of the pin bar 624 and short pin bar 625 and into the spring encoder 628. The spring sub subassembly serves two functions. It limits the CW and CCW rotation of the round plate 604 on footplate sub subassembly 601 to 180 degrees in either direction while returning the round plate 604 to a predetermined home position. The spring sub subassembly 602 also transmits the rotation of the round footplate 604 to the spring encoder 628. The rotation of encoder 628 transmits an electrical signal to the central processor 700, which processes this signal and displays it as the leg twist angle.

Figure 21:
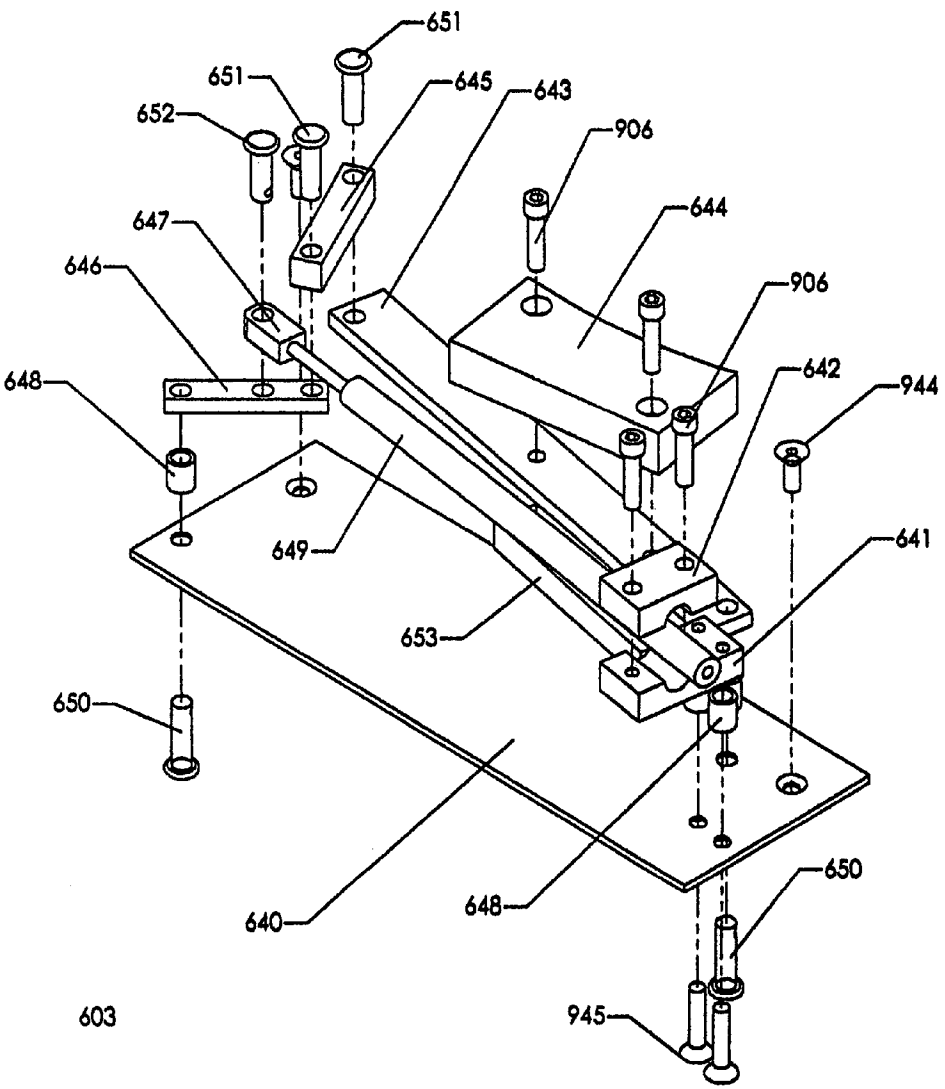
FIG. 21 is an exploded perspective right side view of the turntable brake sub subassembly.

Referring to FIG. 21 the brake subassembly 603 consists of the following items: brake plate 640, bottom cable guide 641, top cable guide 642, brake pad bar 643, brake pad 644, toggle link 645, toggle link 646, rod to link connector 647, spacer 648, brake cable 649, pin 650, pin 651, pin 652, spacer bar 653, and fastening hardware. The brake pad 644 and the brake pad bar 643 are fastened to spacer bar 653, using screw 906. The first end of brake pad bar 643 is pinned to brake plate 640 using pin 650 so that it may pivot about pin 650. The second end of brake pad bar 643 is pinned to toggle link 645 using pin 651, so that toggle link 645 may pivot about pin 651. Toggle link 645 is pinned to toggle link 646 using a second pin 651, so that toggle link 645 and toggle link 646 may pivot about each other. Toggle link 646 is pinned to brake plate 640, through spacer 648, using pin 650, so that toggle link 646 may pivot about pin 650. The brake cable 649 is fastened to brake plate 640 using bottom cable guide 641, top cable guide 642, and spacer 648 to position and capture the brake cable 649 and lock it in place using screws 945, and screws 906. The exposed end of brake cable 649 is inserted into the rod to link connector 647. The rod to link connector 647 is pinned to toggle link 646 using pin 652, so that the rod to link connector 647 may pivot about pin 652. The brake sub subassembly is fastened to horizontal bottom structural members 104 and 105 of frame 100 so that it is adjacent, parallel and flush to the footplate subassembly 601. The user of this invention may twist their leg by first pulling lever 140 on frame 100, thereby releasing brake sub subassembly 603, and allowing round plate 604 of footplate sub subassembly 601 to rotate clockwise or counterclockwise. The user may stop the rotation of round plate 604 by pushing in lever 140 on frame 100 thereby actuating brake subassembly 603.

Figure 22:
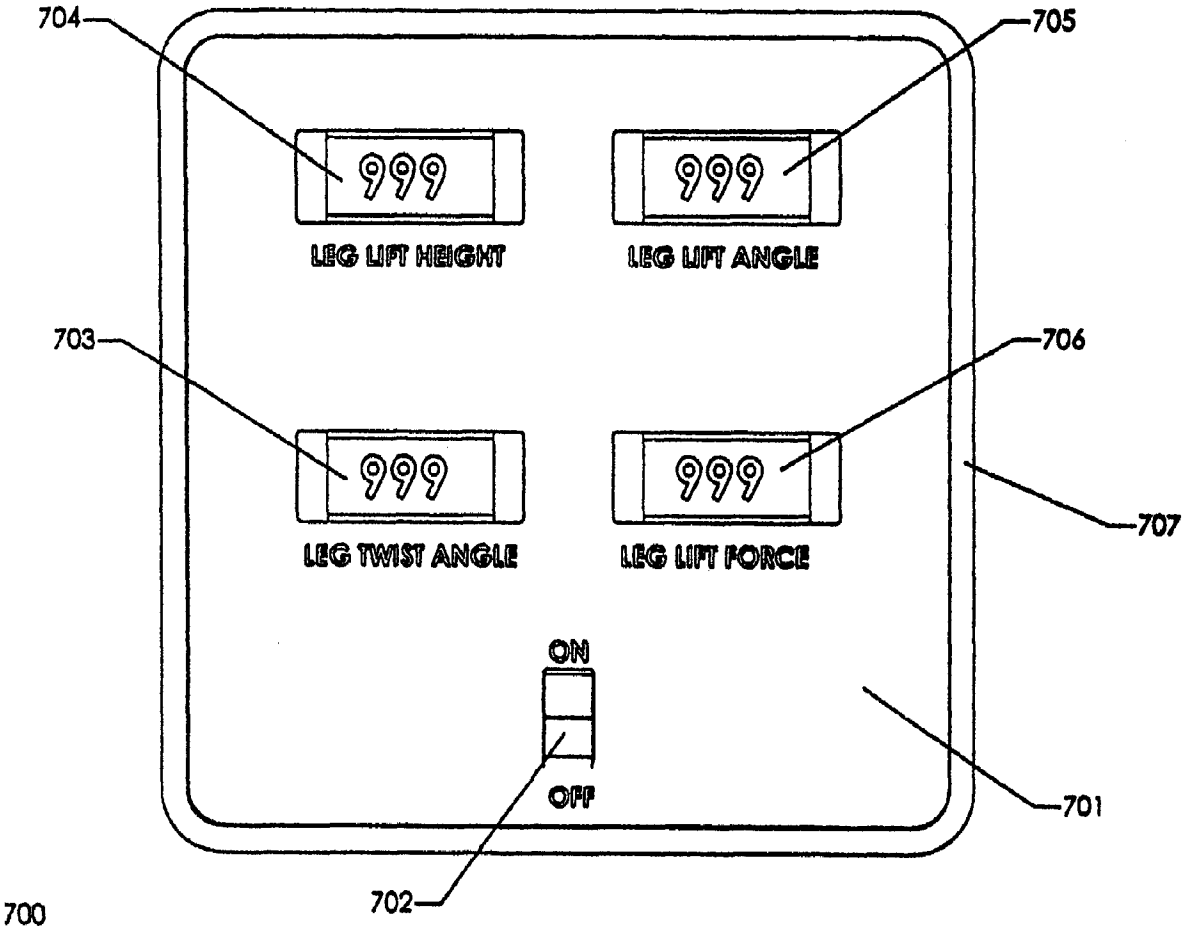
FIG. 22 is a plan view of the central processor subassembly's display panel.
Figure 23:
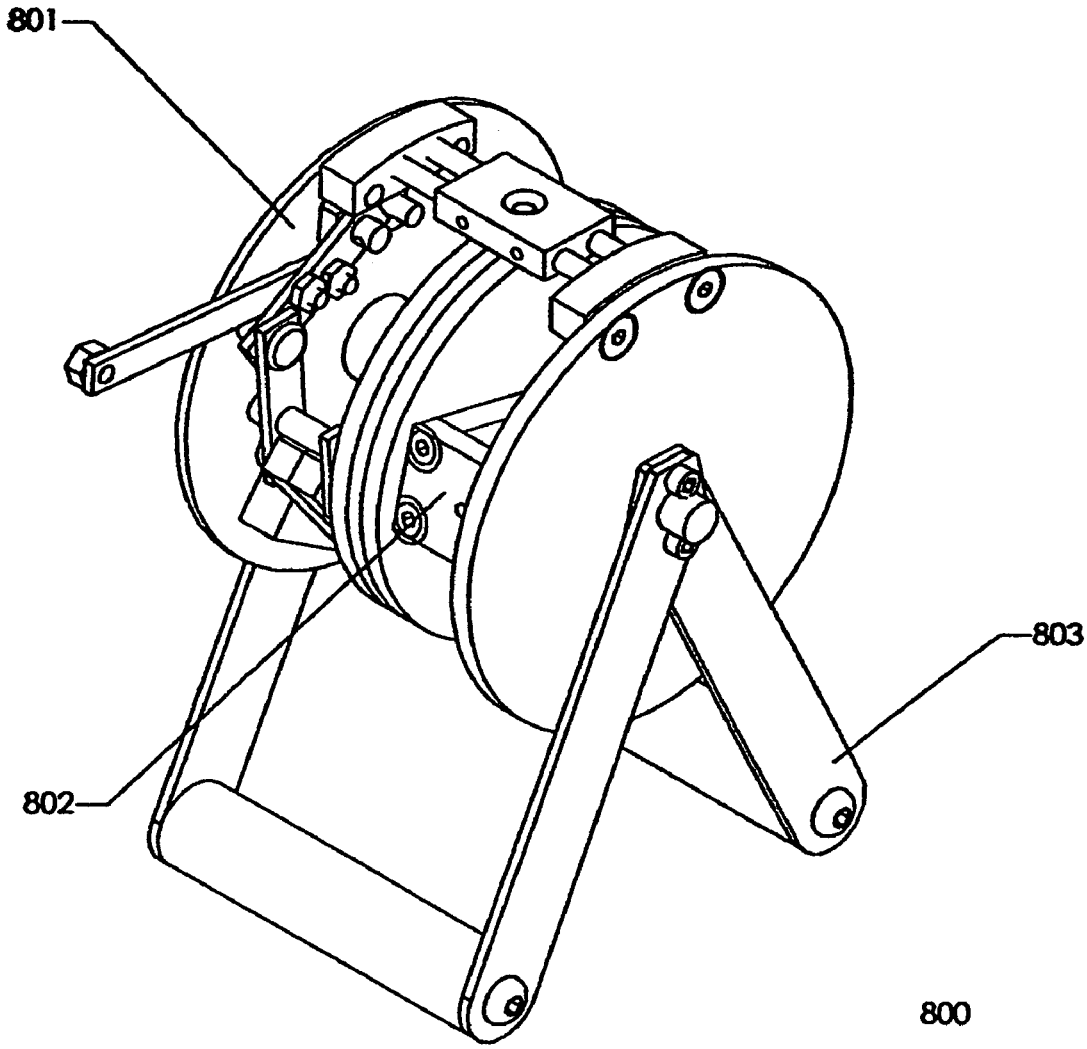
FIG. 23 is a perspective right-side view of the cable pull down subassembly.
Figure 24:
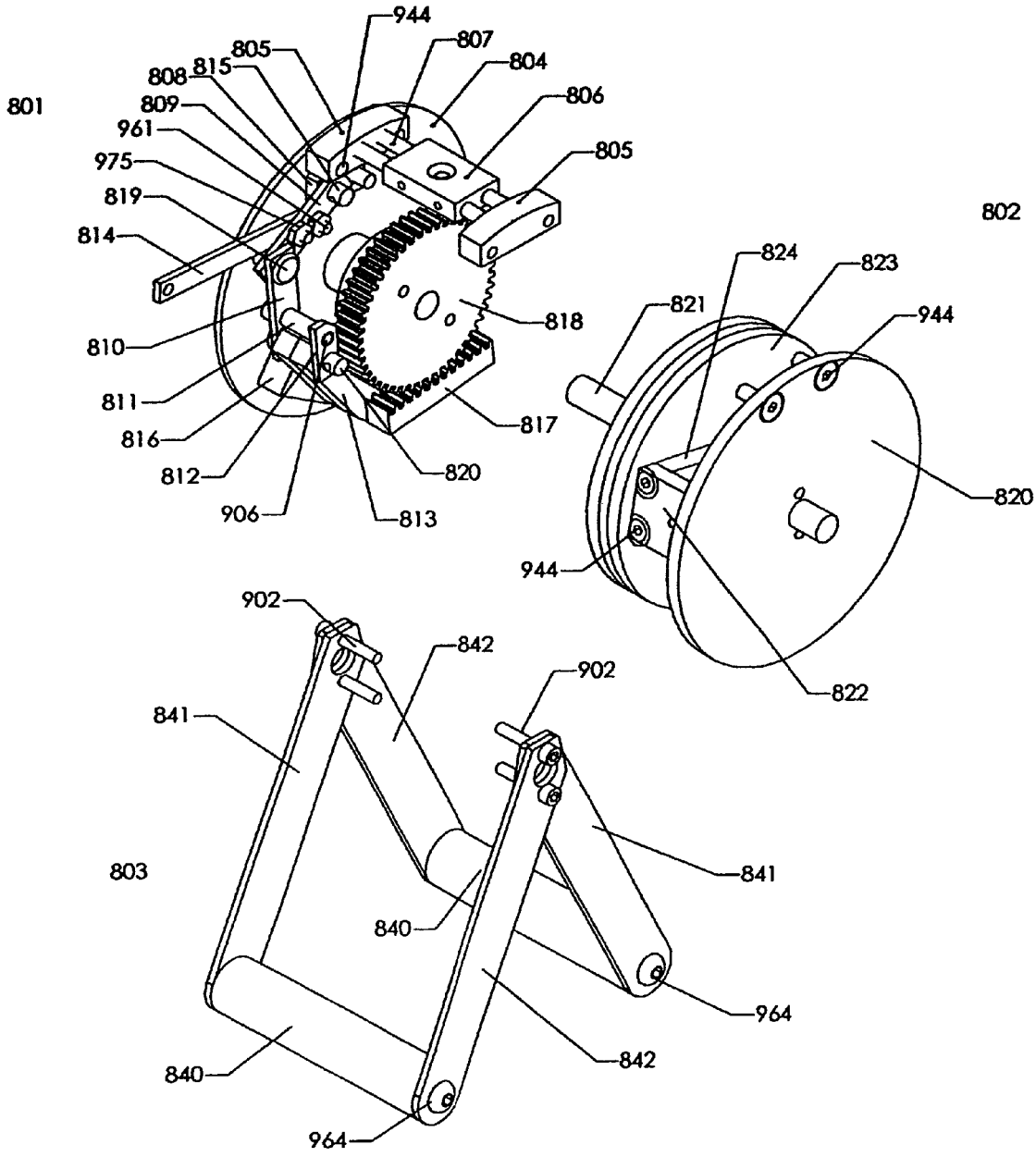
FIG. 24 is an exploded perspective right side view of the three sub subassemblies of the cable pull down subassembly.

Now referring to FIG. 1, FIG. 2, and FIG. 22, a description of the central processor 700 is provided. The central processor hardware consists of an enclosure 707, a face plate 701, a circuit board mounted inside the enclosure (not shown), a first liquid crystal display (LCD) 703, a second LCD 704, a third LCD 705, a fourth LCD 706, and an on/off switch 702. The left edge of enclosure 707 is mounted towards the left end of horizontal central processor structural member 118 of frame 100, so that it faces the turntable 600 and it is approximately at eye level for most users of the muscle-stretching machine. All the LCDs display their information in three place whole numbers without a decimal point. The user of this muscle-stretching machine presses the on/off switch 702 to turn on all LCDs 703, 704, 705, and 706. Each LCD displays the present position of each sensor.

Now referring to FIG. 1, FIG. 2, FIG. 23, and FIG. 24 a description of the cable pull down subassembly 800 is provided. The cable pull down subassembly 800 is made up of three sub subassemblies: the brake sub subassembly 801, the spring sub subassembly 802, and the handle sub subassembly 803. The brake sub subassembly 801 consists of the following items: mounting plate 804, pin block 805, cable guide 806, pin 807, toggle link block 808, toggle link 809, toggle link 810, toggle link spacer 811, short toggle link 812, offset link 813, arm 814, pin 815, offset link block 816, rack 817, gear 818, pin 819, pin 820, fluted handle (not shown, but same as handle 337 of FIG. 10), and fastening hardware. The rack 817 is fastened to offset link 813 so that as the offset link pivots at the 9 o'clock position of gear 818, the rack 817 engages the teeth of gear 818 at the 6 o'clock position. The offset link block 816 accepts the offset link 813 and allows the offset link 813 to pivot on the offset link block 816. Toggle link 809, toggle link 810, and short toggle link 812 are oriented into a toggle assembly using pins 815, 819, and 820 as shown. The first end of this toggle assembly is pinned to toggle link block 808 using pin 815. The second end of this toggle assembly is pinned to offset link 813 using pin 820. The arm 814 attaches to toggle link 809 at an angle as shown. The other end of arm 814 accepts a fluted handle (not shown for the sake of clarity, same as handle 337 FIG. 10), which is used to activate the toggle mechanism, which allows the rack to engage the teeth of the gear 818 thereby acting as a brake. The spring sub subassembly 802 consists of the following items: mounting plate 820, shaft 821, spring lock 822, cable spool 823, spring bar 824, and fastening hardware. The shaft 821 is inserted into and through the mounting plate 820, spring bar 824, and cable spool. The spring bar 824 is fastened to the cable spool 823 and the two are allowed to freely spin together on shaft 821.

The inside end of a constant force spring (not shown) is attached to shaft 821. The outside end of this constant force spring is attached to the spring lock 822. Spring lock 822 is fastened to spring bar 824 using screw 944. The two pin blocks 805, the cable guide 806, and the two pins 807 forms a cable guide for cable 124. This cable guide is fastened to the inside surfaces of mounting plate 804 and mounting plate 820 and guides cable 124 onto and off of cable spool 823. The handle sub subassembly consists of grip 840, inside handle bar 841, outside handle bar 842, and fastening hardware. The two inside handle bars 841 and the two outside handle bars 842 are fastened to grip 840 using screw 964. The opposite ends of inside handle bar 841 and outside handle bar 842 are fastened to the outside surfaces of mounting plate 804 and mounting plate 820 using screw 902. When the user of this muscle-stretching machine wishes to adjust the height of the cable pull down subassembly 800 the toggle mechanism of brake sub subassembly 801 is released, this disengages the rack 817 from the gear 818, which allows the cable spool 823 to freely spin and thereby letting the user pay out or take up cable 124. The spring sub subassembly 802 provides a retracting force to cable 124, similar to how a tape measure retracts its measuring tape. After the desired height of cable pull down subassembly 800 is set, the brake is reset and the cable pull down subassembly 800 is ready to use.

OPERATION

In operation the user makes sure the turntable is locked steps onto the turntable assembly and decides the type of stretch to be performed. If the user decides to use a front leg kick to stretch their leg muscles, then the pivot point of the leg lift subassembly is adjusted so that it is at approximately the same height as the pivot point of the leg into the user's hip. If the user decides to perform a front leg kick using only the lower portion of the leg, then the pivot point of the leg lift subassembly is raised until the thigh is pressed against the user's torso when the leg to be stretched is placed on the leg lift pad subassembly. The pivot point of the leg lift is raised or lowered by rotating the crank on the hand crank subassembly clockwise or counterclockwise. The position of the foam pad may be raised or lowered by loosening the release knob and sliding the foam pad up or down the square tube. The position of the foam pad is changed to suit the comfort level of the user. The handle on the cable pull down subassembly, attached to the end of the cable and near the user's head, is pulled down to raise and lower the leg lift pad. This handle is maintained at a constant height above the turntable subassembly especially when the pivot point of the leg lift subassembly is raised or lowered. When the leg lift subassembly is raised the slack cable subassembly is automatically lowered and thereby takes up the cable slack. When the leg lift subassembly is lowered the slack cable subassembly is automatically raised and the required additional cable is automatically paid out to the leg lift subassembly. Thereby in both instances the handle to raise and lower the leg lift pad subassembly is maintained at a constant height above the turntable subassembly. If the user is too short to reach the height of the handles on the cable pull down subassembly, then the user may lower this height. To do this the user releases the brake on the leg lift subassembly, the counter balance subassembly will raise the leg lift foam pad subassembly, and the cable pull down subassembly will lower and be within reach of the user. The user then releases a brake on the cable pull down subassembly and pulls out additional cable from the cable pull down subassembly. When a sufficient amount of cable is pulled out of the cable pull down subassembly the brake is reapplied. The user then pushes down the leg lift foam pad subassembly, reapplies the brake on the leg lift subassembly, and now the handles on the cable pull down subassembly should be within reach of the user. As previously described the upward stop sub subassembly provides the user, especially a new user, with an upward stop to the maximum angle the leg is allowed to see. The user may set the angle on the upward stop sub subassembly anywhere between 30 and 150 degrees in increments of 10 degrees. Therefore, the user may select one of thirteen upward stop positions prior to using the machine, which will prevent over stretching the leg. Or an experienced user may want to disable this feature by leaving the catch of the upward stop sub subassembly out of the slots. Once the user is positioned with one leg on the leg lift pad subassembly, and the foot of the leg not being stretched is positioned on the turntable subassembly the leg on the leg lift pad subassembly is ready to be stretched. The user turns on the central processor and pulls down on the handles of the cable pull down subassembly, thereby raising the leg lift pad assembly, which in turn raises and stretches the leg. When the handles are pulled the following flexibility feedback information is provided as to the performance of the stretch:

(1) The upward angle of the leg being stretched is displayed in degrees on the front face of the central processor.

(2) The force required to raise the leg being stretched is displayed in pounds on the front face of the central processor (3) The amount of twist applied to the leg not being stretched is displayed in degrees on the front face of the central processor.

(4) The height of the pivot point of the leg being stretched is displayed in inches on the front face of the central processor.

While the user is stretching their leg the turntable brake may be released by pulling a lever adjacent to the user, which will release the turntable brake. This will allow the user's other leg to twist clockwise or counterclockwise, and allow the user to easily transition from a front leg raise to a side leg raise. The turntable brake is immediately reapplied before the user removes their leg from the leg lift foam pad subassembly.

When the user has completed stretching their leg they may stretch the same leg at a different pivot point height, or stretch their other leg at the same pivot point, or stretch their other leg at a different pivot point. When the user is finished using the machine they may depress the on/off switch to turn off the display and then step off of the machine.

It is recognized that changes, variations and modifications may be made to the personal muscle stretching apparatus of this invention without departing from the spirit and scope thereof. Accordingly, no limitation is intended to be imposed thereon except as set forth in the accompanying claims.

I claim:

1. Personal apparatus for stretching the leg, abdominal, groin, and lower back muscles of a user, where said apparatus provides realtime flexibility feedback to said user on the performance of said muscle stretching, said apparatus comprising:

a three-sided, vertically oriented frame system formed by a plurality of vertical frame members and a plurality of horizontal frame members secured thereto to define a floor supporting base, a top, and three sides for said system, where said system is sized to accommodate said user in an upright position;

a manually operable leg lift mounted for vertical movement along at least one said vertical frame member, where said leg lift is vertically adjustable to support the leg of said user, and includes a leg supporting pad for contact with the upper leg or lower leg of said user;

a said base supported rotatable platform for receiving said user in an upright position;

a vertically oriented, adjustable back rest in supporting relationship to the spinal area of said user; and, visual means to provide said realtime feedback to said user on the performance of said stretching, said means including a central processor and visual readouts monitoring said performance.

2. The personal stretching apparatus according to claim 1, wherein said vertically oriented frame members comprise in part a plurality of generally rectangular tubular members.

3. The personal stretching apparatus according to claim 1, wherein there are a pair of parallel vertically oriented frame members consisting of U-shaped channels, the open ends facing one another, where said vertically leg lift is mounted for movement along said channels.

4. The personal stretching apparatus according to claim 3, including a manually operable pulley mechanism to facilitate the vertical movement of said leg lift, said pulley mechanism having a counter balance weight to assist the user to vertically adjust said leg lift.

5. The personal stretching apparatus according to claim 4, wherein said leg supporting pad is rotatable incrementally between first and second positions, and further includes a braking mechanism to stop and hold said rotation at a selected said increment.

6. The personal stretching apparatus according to claim 1, wherein said base supported rotatable platform is rotatable between first and second positions, and further including a rotary encoder and spring mechanism to sense the degree of rotation and transmits the information to said visual means to display the twist angle, and return said platform to a preselected intermediate position when the apparatus is not in use.

7. The personal stretching apparatus according to claim 1, wherein said central processor includes plural digital encoders, a first said digital encoder attached to said leg lift to sense the rotation thereof in communication with said central processor and display on said readouts, and a second said digital encoder attached to said base to supported rotatable platform where it senses the rotation of said platform.

8. The personal stretching apparatus according to claim 1, including a cable to facilitate the adjustability of said leg lift, and wherein said central processor includes a force load cell attached to said cable to sense the leg lift force for communication with said visual means.

9. In combination with a personal apparatus for stretching the leg, abdominal, groin, and lower back muscles of a user, where said apparatus may provide realtime flexibility feedback to said user on the performance of said muscle stretching, said combination including:

a frame structure within which said user may be positioned in a standing mode;

a manually operable leg lift movable along said frame structure, said leg lift mounted to a cable to facilitate its movement, where said leg lift is adjustable along a parallel path to said user;

a pull down mechanism for said cable, including a spool for containing said cable, said pull down mechanism including a spring subassembly, a brake subassembly and a handle subassembly, said handle subassembly allowing said user to manually adjust the relative position of said leg lift, said brake subassembly functioning to lock said spool when said spring subassembly is pulled down by said user; and, a vertically oriented adjustable back rest mounted on said frame structure in supporting relationship to the spinal area of said user.

* * * * *